US008262411B2

(12) United States Patent
Kondo

(10) Patent No.: US 8,262,411 B2
(45) Date of Patent: Sep. 11, 2012

(54) ELECTRICAL CONNECTOR HAVING A CROSSTALK PREVENTION MEMBER

(75) Inventor: Hayato Kondo, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 12/991,984

(22) PCT Filed: May 19, 2009

(86) PCT No.: PCT/JP2009/002204

§ 371 (c)(1),
(2), (4) Date: Nov. 10, 2010

(87) PCT Pub. No.: WO2009/147791

PCT Pub. Date: Dec. 10, 2009

(65) Prior Publication Data

US 2011/0151716 A1 Jun. 23, 2011

(30) Foreign Application Priority Data

Jun. 4, 2008 (JP) ..... 2008-146991

(51) Int. Cl.
*H01R 13/648* (2006.01)

(52) U.S. Cl. ..... 439/607.01

(58) Field of Classification Search ..... 439/607.01, 439/660

See application file for complete search history.

(56) References Cited

U.S. PATENT DOCUMENTS 3,634,806 A * 1/1972 Fergusson ..... 439/497
3,689,865 A * 9/1972 Pierini et al. ..... 439/60
4,950,172 A * 8/1990 Anhalt et al. ..... 439/108
5,156,554 A * 10/1992 Rudoy et al. ..... 439/108
7,004,767 B2 * 2/2006 Kim ..... 439/95
7,422,488 B1 * 9/2008 Wu ..... 439/676
7,481,676 B2 * 1/2009 Walter et al. ..... 439/607.01
7,497,733 B1 * 3/2009 Van der Steen ..... 439/607.01

(Continued)

FOREIGN PATENT DOCUMENTS

JP 11-329594 11/1999

(Continued)

OTHER PUBLICATIONS

International Search Report for International Application No. PCT/JP2009/002204 dated Jun. 23, 2009.

(Continued)

*Primary Examiner* — Amy Cohen Johnson
*Assistant Examiner* — Vladimir Imas
(74) *Attorney, Agent, or Firm* — Kratz, Quintos & Hanson, LLP

(57) ABSTRACT

The invention provides an electrical connector having a cross crosstalk prevention member such as a metal plate readily connectable to ground with simple structure of the connector itself. The electrical connector includes: a housing (10) with an receiving hole (120); contact groups (200*a*, 200*b*), being arranged on opposite sides of the receiving hole in the housing; and a multilayer circuit board (300) to be received in the receiving hole and interposed between the contact groups. The contact groups include ground contacts (220*a*, 220*b*). The multilayer circuit board includes a solid conductor layer (310) provided inside the multilayer circuit board, ground conductors (322, 332) provided on a surface of the multilayer circuit board, and through-holes (340) to connect the solid conductor layer with the conductors. When the multilayer circuit board is received in the receiving hole, the conductors are in contact with the contacts.

23 Claims, 13 Drawing Sheets

U.S. PATENT DOCUMENTS

| | | | | |
|---|---|---|---|---|
| 7,534,141 | B1 * | 5/2009 | Wu | 439/607.01 |
| 7,534,143 | B1 * | 5/2009 | Tsao et al. | 439/607.41 |
| 7,618,293 | B2 * | 11/2009 | Wu | 439/660 |
| 7,625,243 | B2 * | 12/2009 | Chen et al. | 439/660 |
| 7,771,237 | B2 * | 8/2010 | Lei et al. | 439/607.54 |
| 7,811,110 | B2 * | 10/2010 | He et al. | 439/218 |
| 7,896,559 | B2 * | 3/2011 | Yi et al. | 385/75 |
| 2002/0004337 | A1 * | 1/2002 | Chiang | 439/607 |
| 2002/0028604 | A1 | 3/2002 | Lo et al. | 439/607 |
| 2003/0236031 | A1 | 12/2003 | Perugini et al. | 439/607 |
| 2004/0127097 | A1 * | 7/2004 | Korsunsky et al. | 439/607 |
| 2005/0227537 | A1 * | 10/2005 | Peng | 439/607 |
| 2005/0245132 | A1 * | 11/2005 | Huang et al. | 439/607 |
| 2006/0261474 | A1 * | 11/2006 | Jiang et al. | 257/734 |
| 2008/0160830 | A1 * | 7/2008 | Ma | 439/607 |
| 2008/0182452 | A1 * | 7/2008 | Ma | 439/607 |

FOREIGN PATENT DOCUMENTS

| | | | |
|---|---|---|---|
| JP | 2002-50436 | A1 | 2/2002 |
| JP | 2005-327701 | A1 | 11/2005 |
| JP | 2008-41656 | A1 | 2/2008 |

OTHER PUBLICATIONS

Extended European Search Report received in counterpart application No. 09758058.3 mailed Oct. 5, 2011 (6 pages).

* cited by examiner (a)

(b)

(a)

(b)

ELECTRICAL CONNECTOR HAVING A CROSSTALK PREVENTION MEMBER

TECHNICAL FIELD

The present invention relates to electrical connectors having a plurality of first and second contacts.

BACKGROUND ART

A conventional electrical connector of this type has a housing, a plurality of first and second contacts that are arranged on opposite sides in a thickness direction of the housing, and a metal plate interposed between the first and second contacts, the metal plate being connected to ground to reduce crosstalk induced between the first and second contacts (see, e.g., Patent Literature 1).

Patent Literature 1 Japanese Unexamined Patent Publication No. 2005-327701

SUMMARY OF INVENTION

Technical Problem

In the electrical connector, however, a portion of the metal plate is exposed along the lateral surfaces of the housing so as to contact a metal shell covering the outer periphery of the housing, which metal shell is connected to a ground conductor of a cable coupled to the electrical connector, or to a ground circuit on a printed board to which the electrical connector is mounted.

That is, the electrical connector has a structure that definitely requires extraction of a portion of the metal plate out of the housing; therefore, the housing needs to be constructed in a two-piece structure, or extraction holes need to be provided in the housing. Thus, the electrical connector has a disadvantage that the structure thereof inevitably has a complicated structure.

The present invention was made against the backdrop of the foregoing circumstances, and an object of the invention is to provide a novel electrical connector in which a crosstalk prevention member such as a metal plate can be readily connected to a ground without making the structure of the connector itself complicated.

Solution to Problem

An electrical connector according to the present invention includes: a housing having a receiving hole; a first contact group and a second contact group, arranged on opposite sides of the receiving hole in the housing; and a conductive member to be received in the receiving hole in the housing to be interposed between the first contact group and the second contact group. At least one of the first and second contact groups includes a ground contact. The conductive member received in the receiving hole of the housing is in contact with the ground contact.

In such an electrical connector, ground connection is established with the conductive member simply by inserting the conductive member into the receiving hole in the housing so that the conductive member contacts a ground contact of at least one of the first and second contact groups. Accordingly, it is possible to ground the conductive member without providing the housing as a two-piece structure and without boring guiding holes in the housing as in the conventional example, so that the electrical connector can be simplified in structure. In addition, most suitable ground connection is given to the present electrical connector by changing the positions and/or number of the ground contact. Further, as the conductive member is interposed between the first and second contact groups so as to contact the ground contact, crosstalk is less likely to occur between signaling contacts of the first contact group and signaling contacts of the second contact group. Moreover, as at least one of the first and second contact groups includes a ground contact disposed between the signaling contacts of that contact group, crosstalk is less likely to occur among the signaling contacts of that contact group.

The conductive member preferably includes a grounding portion in the form of a projection that is in contact with the ground contact. In this aspect of the invention, the grounding portion contacts the ground contact with the conductive member received in the receiving hole of the housing. Thus, the conductive member can be readily brought into contact with the ground contact while maintaining its function as a conductive member to reduce crosstalk between the signaling contacts of the first contact group and the signaling contacts of the second contact group.

If the conductive member is a metal plate, the grounding portion may be a cut-and-raised piece formed by cutting and bending a portion of the conductive member. In this aspect of the invention, the conductive member and the grounding portion may be fabricated easily by simply cutting and raising a portion of the metal plate using press forming or some other process.

If the conductive member is a plate-like non-conductive material with peripheral surfaces thereof coated with metal, the grounding portion may be a projection provided on the non-conductive material and coated with metal. In this aspect of the invention, the conductive member and the grounding portion can be easily fabricated only by providing a projection on a non-conductive material of resin or other material, and by coating the non-conductive material and the projection with metal.

First locking means for locking the conductive member received in the receiving hole of the housing is preferably provided on at least one of an inner surface of the receiving hole in the housing and the conductive member. In this aspect of the invention, the first locking means locks the conductive member as received in the receiving hole in the housing, the conductive member is readily positioned in relation to the receiving hole in the housing and is prevented from slipping out of the receiving hole.

The conductive member may include: a first crosstalk reducer on a leading end side thereof, being interposed between middle portions of signaling contacts of the first contact group and middle portions of signaling contacts of the second contact group; and a second crosstalk reducer on a rear end side thereof, being interposed between rear end portions of the signaling contacts of the first contact group and rear end portions of the signaling contacts of the second contact group.

In this aspect of the invention, the first crosstalk reducer interposed between the middle portions of the signaling contacts of the first contact group and the middle portions of the signaling contacts of the second contact group helps to reduce crosstalk between the sets of the middle portions. Also, the second crosstalk reducer interposed between the rear end portions of the signaling contacts of the first contact group and the rear end portions of the signaling contacts of the second contact group helps to reduce crosstalk between the sets of the rear end portions. Accordingly, variation in transmission characteristics is reduced among the contacts, so that an electrical connector of high performance can be provided.

If the electrical connector is connectable with a plurality of lead wires, the electrical connector may further includes a lead connection assisting member removably provided at a rear end of the housing. In this case, the signaling contacts of the first and second contact groups may have the middle portions arranged on the opposite sides of the receiving hole in the housing and also have the rear end portions projecting out of a rear surface of the housing. The lead connection assisting member may include: first and second support tables for providing support in soldering the rear end portions of the signaling contacts of the first and second contact groups to cores taken from leading ends of the lead wires; and first lead insertion grooves and second lead insertion grooves provided on rear end sides of the first support table and second support table, respectively, the first and second lead insertion grooves being arranged at equal pitch distance to the pitch distance of the signaling contacts of the first and second contact groups, the first and second lead insertion grooves being adapted to receive and temporarily hold the respective leading ends of the lead wires. The first crosstalk reducer is received in the receiving hole in the housing, and the second crosstalk reducer is interposed between a portion of the lead connection assisting member including the first support table and the first lead insertion grooves and a portion of the lead connection assisting member including the second support table and the second lead insertion grooves of the lead connection assisting member.

In this aspect of the invention, as the second crosstalk reducer of the conductive member is interposed between the first support table as well as the first lead insertion grooves and the second support table as well as the second lead insertion grooves, it is possible to reduce crosstalk that may occur between the rear end portions of the signaling contacts of the first contact group as well as the cores of the lead wires connected thereto and the rear end portions of the signaling contacts of the second contact group as well as the cores of the lead wires connected thereto. Further, the first and second lead insertion grooves of the lead connection assisting member serves temporarily hold the leading ends of the lead wires on the rear side of the housing. In addition, the cores taken from the leading ends of the lead wires, together with the rear end portions of the signaling contacts of the first and second contact groups projecting out of the rear surface of the housing, are supported on the support tables of the lead connection assisting member. Thus, the cores and the rear end portions of the contacts can be soldered to one another in a single collective soldering using a pulse heating or other method, and also the solder can be supplied in an even amount to each soldered portion. Accordingly, it becomes possible to improve the mass productivity of the electrical connector and to reduce variation in transmission characteristics among the lead wires due to an uneven supply amount of solder to the soldered portions. It is thus possible to provide electrical connectors of high performance.

A pair of guide means for movably guiding the lead connection assisting member in a longitudinal direction may preferably be provided on opposite ends of the rear end of the housing. In this aspect of the invention, the lead connection assisting member is guided by the pair of guide means and attached to the rear end of the housing, facilitating attachment of the lead connection assisting member to the housing. It is thus possible to reduce assembly costs.

Second locking means is preferably provided on at least one of the pair of guide means and the lead connection assisting member, the second locking means being adapted to lock the lead connection assisting member as guided by the guide means and as attached to the rear end of the housing. In this aspect of the invention, the second locking means locks the lead connection assisting member as guided by the guide means and as attached to the rear end of the housing. In this manner, the lead connection assisting member is readily attached to the rear end of the housing, and further assembly cost can be reduced. Moreover, it is possible to prevent the lead connection assisting member from slipping off from the rear end of the housing.

First guide grooves and second guide grooves may preferably be provided in the first and second support tables, respectively, of the lead connection assisting member in such a manner as to communicate with the first and second lead insertion grooves, the first and second guide grooves being adapted to guide the rear end portions of the signaling contacts of the first and second contact groups, respectively. In this aspect of the invention, upon attachment of the lead connection assisting member on the rear of the housing, the rear end portions of the signaling contacts of the first and second contact groups enter the first and second guide grooves on the support tables to be thereby guided and positioned in places so as to be opposed to the first and second lead insertion grooves. In this manner, the rear end portions of the contacts are readily aligned in relation to the cores of the lead wires located and held in the first and second lead insertion grooves. It is thus possible to further reduce assembly costs.

The first and second lead insertion grooves may each have a slightly smaller lateral dimension than each lateral dimension of the leading ends of the lead wires such that the leading ends of the lead wires are allowed to be press-fitted and retained in the first and second lead insertion grooves. First and second lead insertion grooves may each have barbs pointing inward at opposite ends of an open side thereof, the barbs preventing the leading ends of the lead wires from slipping off. In these aspects of the invention, the leading ends of the lead wires are reliably positioned and retained, improving accuracy in soldering.

The above electrical connector may include a shield cover for covering peripheral surfaces of the housing and a case for protecting an entire proximal end of the electrical connector.

The above electrical connector may further include, in place of the conductive member, a multilayer circuit board to be received in the receiving hole of the housing and be interposed between the first and second contact groups. The multilayer circuit board may includes: a solid conductor layer provided inside the multilayer board; a ground conductor provided on at least one of opposite surfaces of the multilayer circuit board; and a via hole connecting between the solid conductor layer and the ground conductor. When the multilayer circuit board is received in the receiving hole, the ground conductor of the multilayer circuit board is in contact with the ground contact.

In such an electrical connector, the solid conductor layer of the multilayer board is grounded simply by inserting the multilayer circuit board into the receiving hole in the housing so that the ground conductor of the multilayer board contacts the ground contact of at least one of the first and second contact groups. This configuration allows the solid conductor layer to exert a similar function to that of the above-described conductive member, i.e., reducing crosstalk between the signaling contacts of the first contact group and the signaling contacts of the second contact group. In this aspect of the invention using the multilayer circuit board in place of the conductive member, the solid conductor layer of the multilayer circuit board is grounded simply by inserting the board into the receiving hole, it is possible to ground the solid conductor layer without providing the housing as a two-piece structure and without boring guiding holes in the housing as in the conventional example. The electrical connector can thus be simplified in structure. In addition, most suitable ground connection is given to the present electrical connector by changing the positions and/or number of the ground contact.

The rear end of the ground contact may preferably be in contact with and soldered to the conductor of the multilayer circuit board. In this aspect of the invention, the rear end of the ground contact is electrically and mechanically connected to the conductor of the multilayer circuit board. Accordingly, the connection of the ground contact with the conductor can be maintained even when external force or the like is applied to the ground contact.

If the multilayer board further includes signaling conductors provided on at least one of the opposite surfaces of the multilayer circuit board, rear end portions of the signaling contacts of the first and second contact groups may be in contact with and soldered to the signaling conductors of the multilayer circuit board.

The solid conductor layer may include: a first crosstalk reducer on a leading end side thereof, interposed between middle portions of the signaling contacts of the first contact group and middle portions of the signaling contacts of the second contact group; and a second crosstalk reducer on a rear end side thereof, interposed between the rear end portions of the signaling contacts of the first contact group and the rear end portions of the signaling contacts of the second contact group.

In this aspect of the invention, the first crosstalk reducer interposed between the middle portions of the signaling contacts of the first contact group and the middle portions of the signaling contacts of the second contact group acts to reduce crosstalk between the sets of middle portions. Also, the second crosstalk reducer interposed between the rear end portions of the signaling contacts of the first contact group and the rear end portions of the signaling contacts of the second contact group acts to reduce crosstalk between the sets of rear end portions. Accordingly, variation in transmission characteristics is reduced among the contacts, so that it is possible to provide an electrical connector of high performance.

If the above electrical connector is connectable with a plurality of lead wires, cores taken from the leading ends of the lead wires can be soldered to at least the signaling conductors or the rear end portions of the signaling contacts, respectively.

If the cores are soldered to the signaling conductors, the above electrical connector may further include a block of insulating resin, the block being embedded with the rear end portions of the signaling contacts, the rear end of the ground contact, the leading ends of the lead wires with the cores thereof soldered to the signaling conductors, and the multilayer circuit board excluding a leading end thereof.

If the cores are soldered to the rear end portions of the signaling contacts, the above electrical connector may further include a block of insulating resin, the block being embedded with the rear end portions of the signaling contacts, the rear end of the ground contact, the leading ends of the lead wires with the cores thereof soldered to the rear end portions of the signaling contacts, and the multilayer circuit board excluding a leading end thereof.

In either case, the block can retain the soldered state of the cores of the lead wires with the signaling conductors or with the rear end portions of the signaling contacts, so that it is possible to prevent the soldering from inadvertently coming off even if external force is applied to the lead wires.

DESCRIPTION OF EMBODIMENTS

Electrical connectors according to Embodiments 1 and 2 of the present invention will be described below.

Embodiment 1

Figure 1:
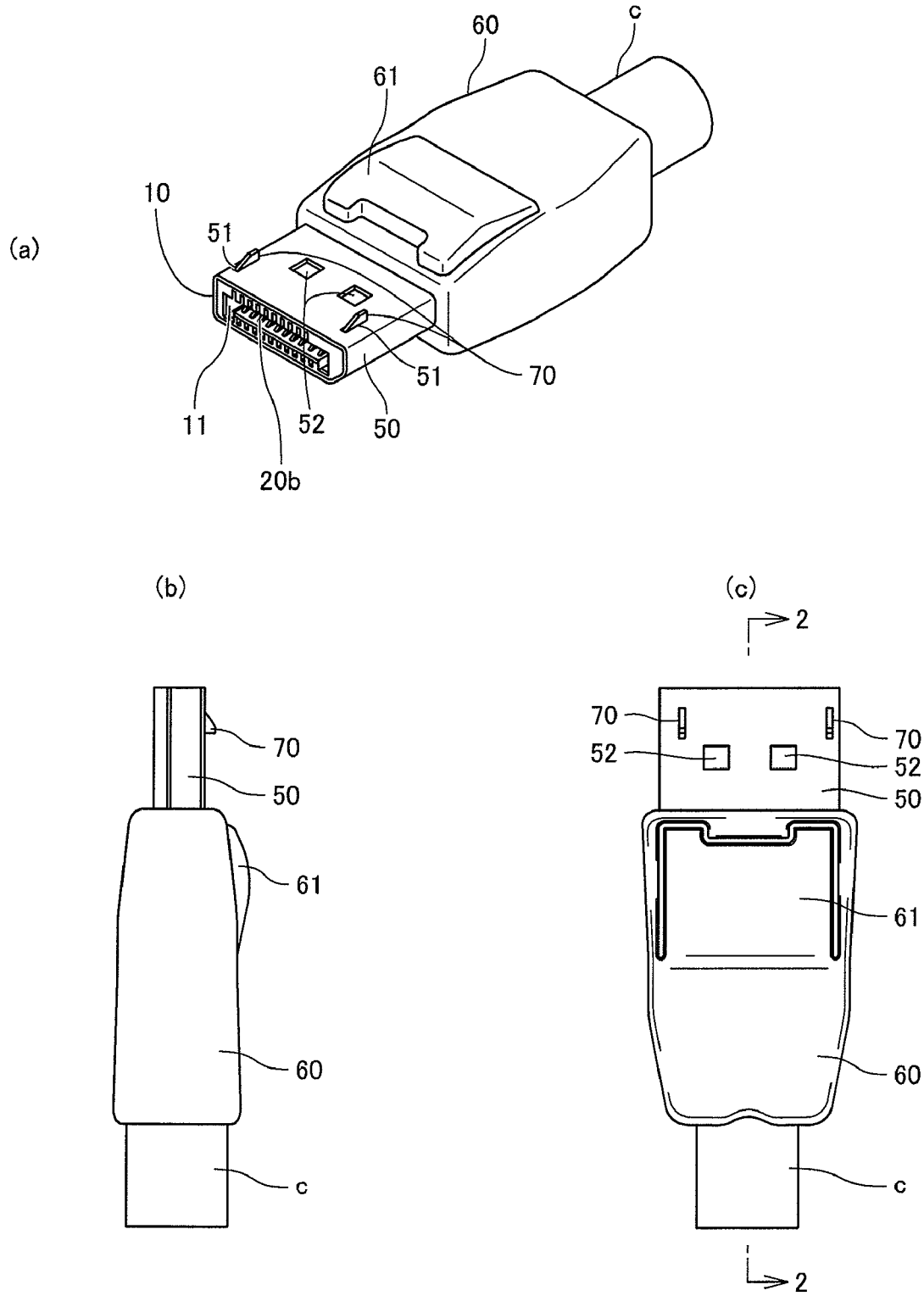
FIGS. 1(*a*) to 1(*c*) are schematic views of an electrical connector according to Embodiment 1 of the present invention, wherein FIG. 1(*a*) is a perspective view, FIG. 1(*b*) is a side view, and FIG. 1(*c*) is a plan view.
Figure 2:
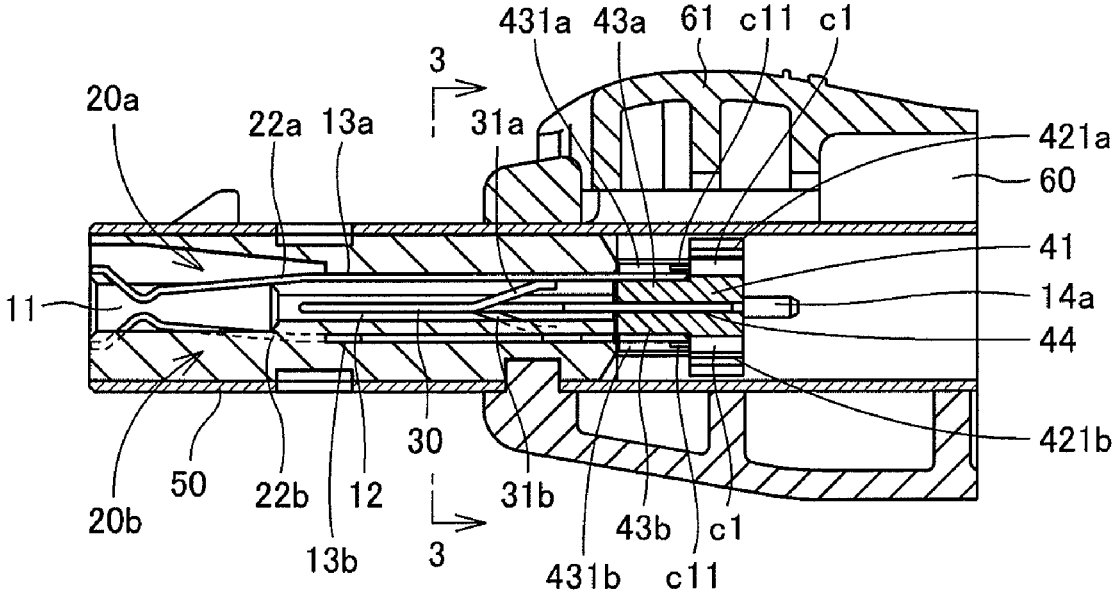
FIG. 2 is a cross-sectional schematic view of the connector, taken along line 2-2 of FIG. 1(*c*).
Figure 3:
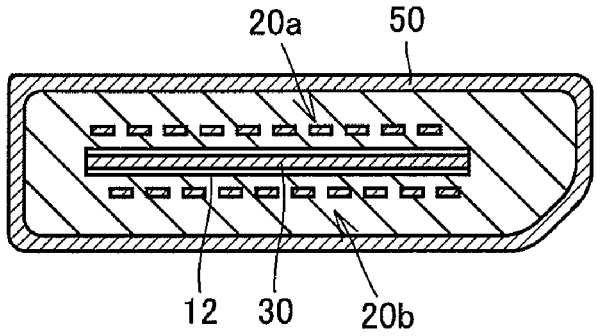
FIG. 3 is a schematic end view of the connector, taken along line 3-3 of FIG. 2.
Figure 4:
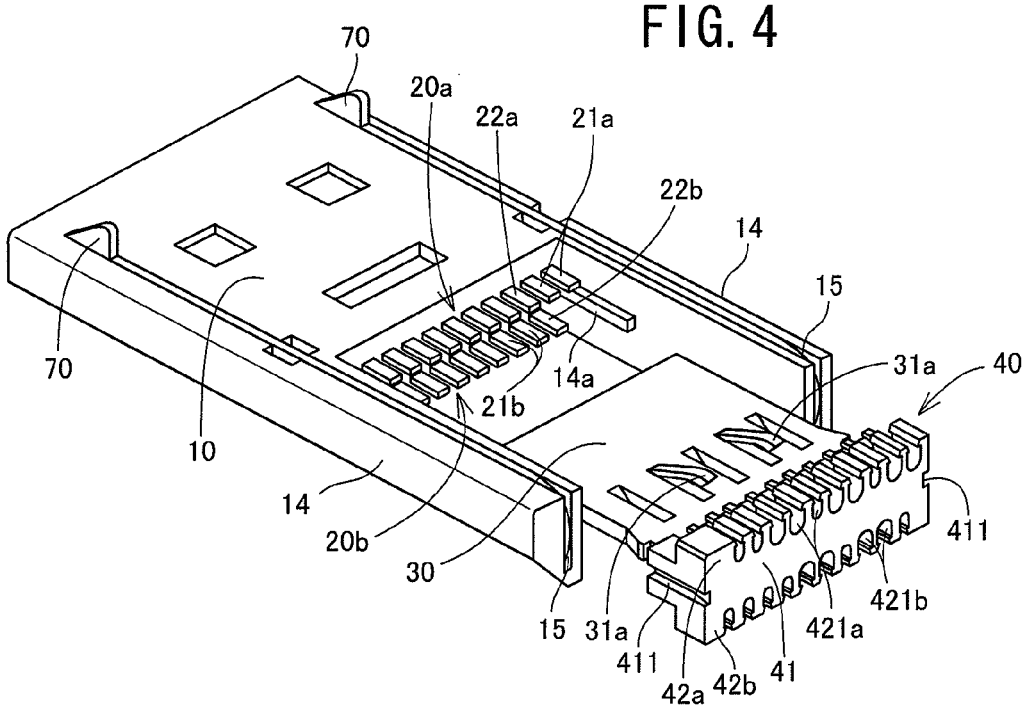
FIG. 4 is an exploded perspective schematic view of a housing, a conductive member, and a lead connection assisting member of the connector.
Figure 5:
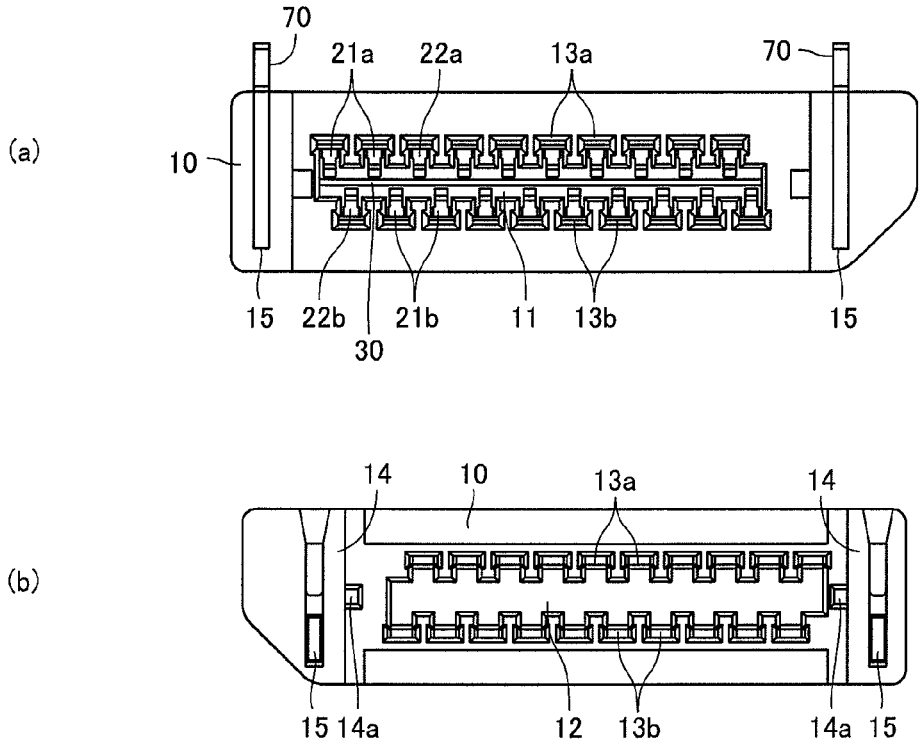
FIGS. 5(*a*) and 5(*b*) are schematic views of the housing of the connector, wherein FIG. 5(*a*) is a front view of the housing with contacts and the conductive member attached thereto, and FIG. 5(*b*) is a rear view thereof.
Figure 6:
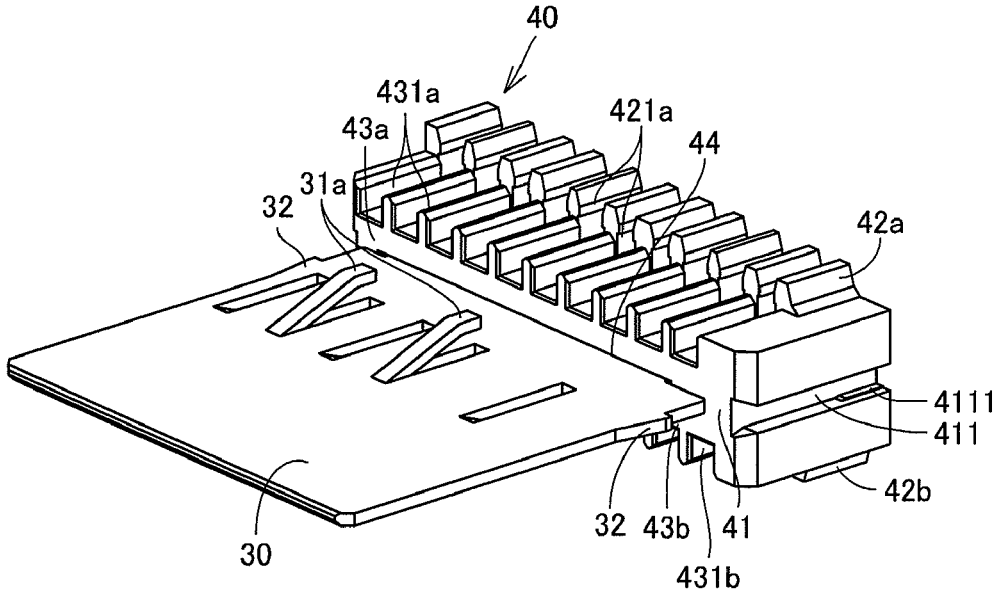
FIGS. 6(*a*) and 6(*b*) are schematic views of the conductive member and the lead connection assisting member of the connector, wherein FIG. 6(*a*) is a perspective view, and FIG. 6(*b*) is a side view.
Figure 6:
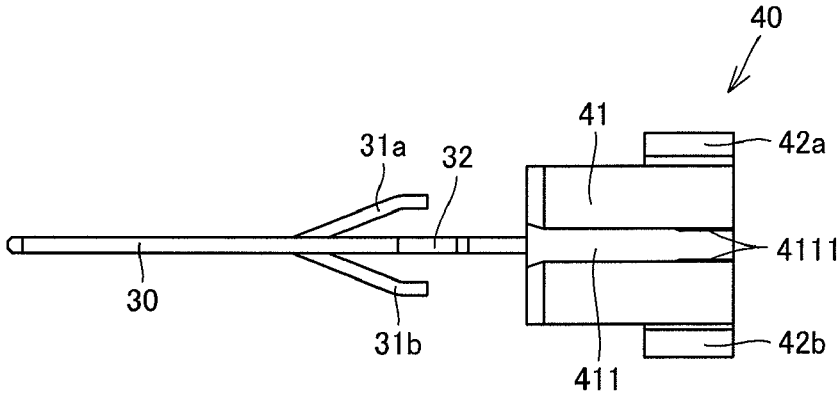
Figure 7:
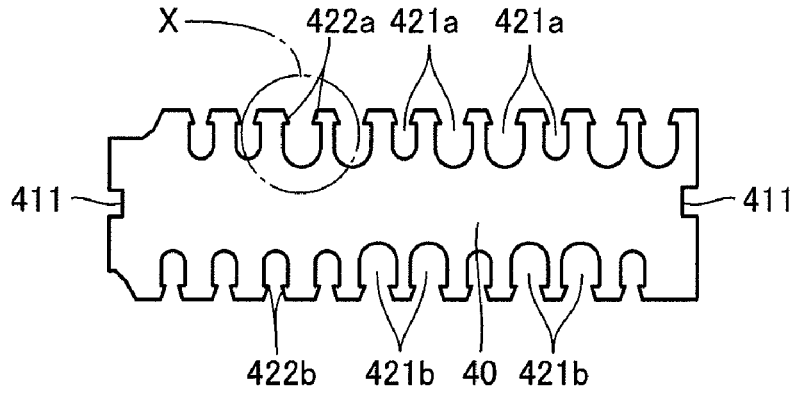
FIGS. 7(*a*) and 7(*b*) are schematic views of the lead connection assisting member of the connector, wherein FIG. 7(*a*) is a rear view, and FIG. 7(*b*) is an enlarged view of an area X indicated in FIG. 7(*a*).
Figure 7:
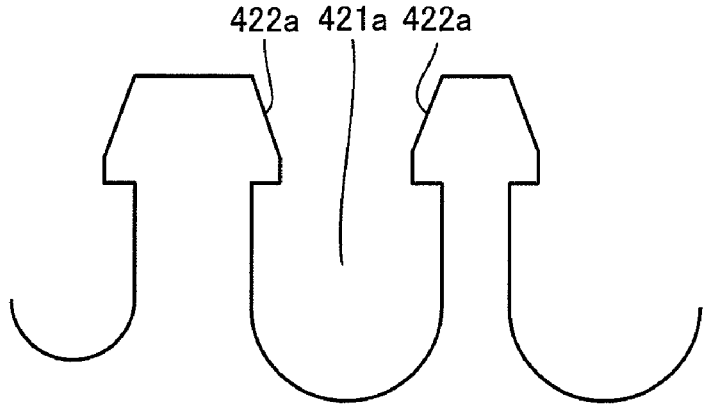
Figure 8:
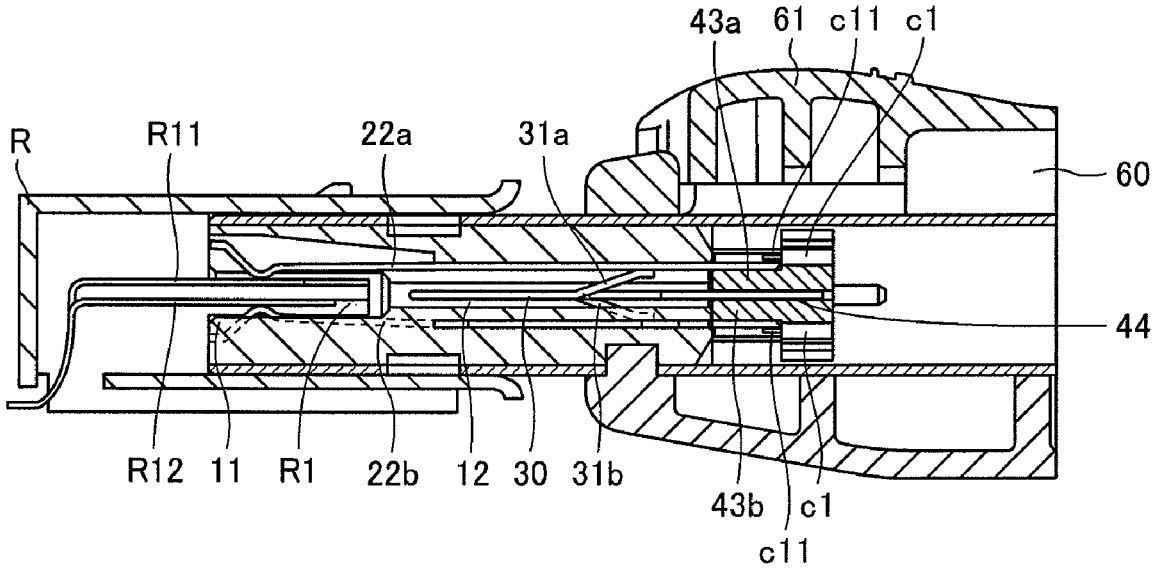
FIG. 8 is a schematic cross-sectional view of the connector coupled to a receptacle connector.

First, an electrical connector according to Embodiment 1 of the present invention is described below with reference to the drawings. FIGS. 1(*a*) to 1(*c*) are schematic views of the electrical connector, wherein FIG. 1(*a*) is a perspective view, FIG. 1(*b*) is a side view, and FIG. 1(*c*) is a plan view. FIG. 2 is a cross-sectional schematic view of the connector, taken along line 2-2 of FIG. 1(*c*). FIG. 3 is a schematic end view of the connector, taken along line 3-3 of FIG. 2. FIG. 4 is an exploded perspective schematic view of a housing, a conductive member, and a lead connection assisting member of the connector. FIGS. 5(*a*) and 5(*b*) are schematic views of the housing of the connector, wherein FIG. 5(*a*) is a front view of the housing with contacts and the conductive member attached thereto, and FIG. 5(*b*) is a rear view. FIGS. 6(*a*) and 6(*b*) are schematic views of the conductive member and the lead connection assisting member of the connector, wherein FIG. 6(*a*) is a perspective view, and FIG. 6(*b*) is a side view. FIGS. 7(*a*) and 7(*b*) are schematic views of the lead connection assisting member of the connector, wherein FIG. 7(*a*) is a rear view, and FIG. 7(*b*) is an enlarged view of an area X indicated in FIG. 7(*a*). FIG. 8 is a schematic cross-sectional view of the connector coupled to a receptacle connector.

The electrical connector as shown in FIGS. 1(*a*) and 1(*b*) is a plug connector referred to as DisplayPort, adapted for attachment to a leading end of a bulk cable c for use in high speed signaling. The electrical connector includes a housing 10, first and second contact groups 20*a* and 20*b*, a conductive member 30, a lead connection assisting member 40, a shield cover 50, and a case 60. Each component of the connector will be described below in detail.

As shown in FIGS. 1(*a*) to 5(*b*), the housing 10 is an molded article of insulative resin. The housing 10 has a main body of generally rectangular parallelepiped shape. The leading end of the main body has an opening 11. The rear end of the main body has an receiving hole 12 communicating with the opening 11. Moreover, a plurality of upper and lower contact containing grooves 13*a* and 13*b* are formed at predetermined intervals above and below, respectively, the opening 11 and the receiving hole 12 of the main body. A pair of guide plates 14 (guide means) is provided at widthwise ends of the rear endface of the main body. A pair of lock terminal containing grooves 15 is formed along the widthwise ends the main body and along the guide plates 14.

The opening 11 is a generally rectangular hole opening frontward to receive a connecting protrusion R1 (see FIG. 8) of a receptacle connector R of an electronic instrument etc.

The receiving hole 12 is a generally rectangular hole opening rearward to receive the conductive member 30.

As shown in FIG. 2, the upper and lower contact containing grooves 13*a* and 13*b* are recesses that are elongated in a longitudinal direction of the housing 10 and communicate with the opening 11 and the receiving hole 12. The upper contact containing grooves 13*a* are arranged out of phase with the lower contact containing grooves 13*b*, as shown in FIGS. 5(*a*) and 5(*b*). The upper and lower contact containing grooves 13*a* and 13*b* are arranged at equal pitch distance to upper and lower contacts R11 and R12, respectively, that are provided on the upper and lower surfaces of the connecting protrusion R1 of the receptacle connector R. The contacts of the first and second contact groups 20*a* and 20*b* are contained in the upper and lower contact containing grooves 13*a* and 13*b*, respectively, so that the contacts of the first and second contact groups 20*a* and 20*b* are disposed on the upper side and the lower side, respectively, of the receiving hole 12 in the housing 10.

As shown in FIG. 4, paired guide projections 14*a* are provided on the inner surfaces of the guide plates 14. The guide projections 14*a* fit in paired guide recesses 411 formed along the lateral edges of the lead connection assisting member 40, so that the lead connection assisting member 40 is guided toward the rear end of the main body of the housing 10.

Lock terminals 70, generally U shaped resilient metal bodies, are inserted for attachment into the lock terminal containing grooves 15. The leading ends of the lock terminals 70 are thus able to rise from and sink into the lock terminal containing grooves 15.

As shown in FIGS. 2 to 5(*b*), the first contact group 20*a* includes a plurality of signaling contacts 21*a* and ground contacts 22*a*. The signaling contacts 21*a* and the ground contacts 22*a*, which are the same metal plates having leading ends bent in a generally V-shape, are contained in the upper contact containing grooves 13*a* so as to be arranged in line along the width of the housing 10. When the signaling contacts 21*a* and the ground contacts 22*a* are arranged in place, their leading ends are situated in an upper part of the opening 11 in the housing 10, and their middle portions are situated above the receiving hole 12 in the housing 10. As shown in FIG. 4, the rear end portions of the signaling contacts 21*a* and of the ground contacts 22*a* project out of the rear face of the main body of the housing 10. These rear end portions constitute connection portions to be soldered to cores c11 that are taken from a plurality of lead wires c1 incorporated in the cable c, as illustrated in FIG. 2.

The second contact group 20*b* also includes a plurality of signaling contacts 21*b* and ground contacts 22*b*. The signaling contacts 21*b* and the ground contacts 22*b*, which are the same metal plates having leading ends bent in a generally V-shape, are contained in the lower contact containing grooves 13*b* so as to be arranged in line along the width of the housing 10. When the signaling contacts 21*b* and the ground contacts 22*b* are arranged in place, their leading ends are situated in a lower part of the opening 11 in the housing 10 and their middle portions are situated below the receiving hole 12 in the housing 10. As shown in FIG. 4, the rear end portions of the signaling contacts 21*b* and of the ground contacts 22*b* project out of the rear surface of the main body of the housing 10. These rear end portions constitute connection portions to be soldered with cores c11 that are taken from lead wires c1 incorporated in the cable c, as illustrated in FIG. 2.

As shown in FIGS. 2, 3, 5(*a*), 6(*a*) and 6(*b*), the conductive member 30 is a generally rectangular metal plate formed by press forming. It is inserted into the receiving hole 12 in the housing 10 to be interposed between the first and second contact groups 20*a* and 20*b*. The conductive member 30 has a leading end portion (a first crosstalk reducer) to be received in the receiving hole 12 in the housing 10 and a rear end portion (a second crosstalk reducer) to be fitted in an attachment hole 44 in the lead connection assisting member 40.

The leading end portion of the conductive member 30 has a length dimension that is substantially equal to the length dimension of the middle portions of the signaling contacts 21*a* and 21*b* and of the ground contacts 22*a* and 22*b*. The rear end portion of the conductive member 30 has a length dimension that is larger than the length dimension of the rear end portions of the signaling contacts 21*a* and 21*b* and of the ground contacts 22*a* and 22*b*.

In the leading end portion of the conductive member 30, its rear area are cut at portions to form two cut-and-raised pieces 31*a* bent upward (to serve as grounding portions in the form of projections) and three cut-and-raised pieces 31*b* bent downward (to serve as grounding portions in the form of projections). The cut-and-raised pieces 31*a* and 31*b* are arranged alternately, and they are adapted to touch the ground contacts 22*a* and 22*b* with the leading end portion of the conductive member 30 received in the receiving hole 12 in the housing 10. It should be noted that the rear area are cut out at said portions so as not to produce substantial gaps between the end faces of the portions to become the cut-and-raised pieces 31*a* and 31*b* and the end faces of openings formed in the rear area. More specifically, the widthwise dimensions of the cut-and-raised pieces 31*a* and 31*b* are set substantially equal to the widthwise dimensions of the openings. This structure prevents the crosstalk reducing effect of the conductive member 30 from being impaired due to signal leaks through the gaps, which signals are generated between the signaling contacts 21*a* of the first contact group 20*a* and the signaling contacts 21*b* of the second contact group 20*b*.

The widthwise ends in the rear area are provided with paired locking projections 32 (first locking means). The widthwise dimension of the rear area including the paired locking projections 32 is slightly larger than the widthwise dimension of the receiving hole 12 of the housing 10. Accordingly, when the leading end portion of the conductive member 30 is press-fitted into the receiving hole 12 of the housing 10, the pair of locking projections 32 are locked in the receiving hole 12 of the housing 10. The press-fitted conductive member 30 is disposed as shown in FIG. 2, i.e., it runs parallel to the middle portions and rear end portions of the contacts of the first and second contact groups 20*a* and 20*b*.

As shown in FIGS. 2, 4, 6(*a*) and 6(*b*), the lead connection assisting member 40 is a molded article of insulative resin, and it is attached to the rear end of the housing 10. The lead connection assisting member 40 has a generally rectangular parallelepiped base 41, a first vertical wall 42*a* and a second vertical wall 42*b* that are provided upright on the upper and lower surfaces, respectively, of the rear end of the base 41, a first support table 43*a* and a second support table 43*b* of rectangular plate-like shape that are provided on the upper and lower surfaces of the leading end of the base 41, and the generally rectangular attachment hole 44 formed in the leading endface of the base 41.

The base 41 is provided in its lateral faces with the guide recesses 411 to receive the pair of guide projections 14*a* of the housing 10. The guide recesses 411 each have, on its upper and lower surfaces in the rearmost portions, locking projections 4111 (second locking means). The distance between the upper and lower locking projections 4111 is slightly smaller than the thickness dimension of the guide projections 14*a*. As such, the guide projections 14*a* inserted into the guide recesses 411 are press fitted between the upper and lower locking projections 4111, so that the lead connection assisting member 40 is securely attached to the rear end of the housing 10. As the guide projections 14*a* guide the guide recesses 411, the lead connection assisting member 40 can be easily attached to the rear end of the housing 10, the conductive member 30 can be easily inserted in position in the receiving hole 12 in the housing 10.

As shown in FIGS. 2, 6(*a*), 6(*b*), 7(*a*), and 7(*b*), the first vertical wall 42*a* is provided with a plurality of first lead insertion grooves 421*a* at an equal pitch distance to the pitch distance of the signaling contacts 21*a* and the ground contacts 22*a*. The first lead insertion grooves 421*a* are used to receive and temporally hold the leading ends of the lead wires c1 of the cable c. The first lead insertion grooves 421*a* are slightly smaller in lateral dimension than the leading ends of the lead wires c1 so as to press-fit and hold therein the leading ends of the lead wires c1. Moreover, the first lead insertion grooves 421*a* are each provided at its ends on the open side with barbs 422*a* and 422*a* extending inward for preventing the leading end of the lead wire c1 from slipping out of the groove.

The second vertical wall 42*b* is provided with a plurality of second lead insertion grooves 421*b* at an equal pitch distance to the pitch distance of the signaling contacts 21*b* and the ground contacts 22*b*. The second lead insertion grooves 421*b* are used to receive and temporally hold the leading ends of the lead wires c1 of the cable c. The second lead insertion grooves 421*b* shall not be described in detail because they have the same configuration as the first lead insertion grooves 421*a*.

As shown in FIGS. 2 and 6(*a*), the first support table 43*a* serves to provide support for soldering the rear end portions of the signaling contacts 21*a* and of the ground contacts 22*a* to the cores c11 taken from the leading ends of the lead wires c1 of the cable c. The surface of the first support table 43*a* is provided with a plurality of first guide grooves 431*a* for guiding the rear end portions of the signaling contacts 21*a* and of the ground contacts 22*a*, in communication with the first lead insertion grooves 421*a*.

The second support table 43*b* serves to provide support for soldering the rear end portions of the signaling contacts 21*b* and of the ground contacts 22*b* to the cores c11 taken from the leading ends of the lead wires c1 of the cable c. The surface of the second support table 43*b* is provided with a plurality of second guide grooves 431*b* for guiding the rear end portions of the signaling contacts 21*b* and of the ground contacts 22*b*, in communication with the second lead insertion grooves 421*b*.

As shown in FIG. 2, the depth of the attachment hole 44 is defined from the leading endface of the base 41 to a portion between the first and second vertical walls 42*a* and 42*b*. Accordingly, the rear end portion of the conductive member 30 fitted in the attachment hole 44 is located in the space below the first support table 43*a* and the first lead insertion grooves 421*a* and above the second support table 43*b* and the second lead insertion grooves 421*b*. In other words, the rear end portion of the conductive member 30 is located in the space below the signaling contacts 21*a* and the cores c11 of the lead wires c1 of the cable c soldered thereto and above the signaling contacts 21*b* and the cores c11 of the lead wires c1 of the cable c soldered thereto, thereby reducing crosstalk generated therebetween.

As shown in FIGS. 1(*a*) to 1(*c*) and 2, the shield cover 50 is a rectangular tuboid shell that covers the outer peripheral surfaces of the housing 10. In a front portion on the upper surface of the shield cover 50, there are formed side by side paired holes 51, for passing the leading ends of the lock terminals 70 therethrough, and locking holes 52, for locking portions of the receptacle connector R.

The case 60 is a resin-molded body that houses the housing 10 and the shield cover 50 and protects the proximal end of the shield cover 50. A press button 61 is disposed on the upper surface of the case 60 for switching between lock and release of the receptacle connector. More specifically, inside the case 60, the press button 61 is coupled to the proximal ends of the lock terminals 70, allowing the leading ends of the lock terminals 70 to move up and down.

The electrical connector having components as described above is assembled in the following steps. First, the signaling contacts 21*a* and the ground contacts 22*a* are press-fitted into the upper contact containing grooves 13*a* in the housing 10. Similarly, the signaling contacts 21*b* and the ground contacts 22*b* are press-fitted into the lower contact containing grooves 13*b* in the housing 10. In this state, the rear end portions of the signaling contacts 21*a* and of the ground contacts 22*a* project from the rear surface of the main body of the housing 10, and the rear end portions of the signaling contacts 21*b* and of the ground contacts 22*b* project from the rear surface of the main body of the housing 10. The signaling contacts 21*a* and the ground contacts 22*a* are thus arranged above the receiving hole 12 in the housing 10, out of phase with the signaling contacts 21*b* and the ground contacts 22*b* below the receiving hole 12.

After that, the rear end portion of the conductive member 30 is fitted into the attachment hole 44 in the lead connection assisting member 40. The leading end portion of the conductive member 30 is then inserted into the receiving hole 12 in the housing 10, while the pair of guide projections 14*a* of the housing 10 is inserted into the pair of guide recesses 411 on the lead connection assisting member 40. Then the cut-and-raised pieces 31*a* and 31*b* of the conductive member 30 are brought into contact with the respective ground contacts 22*a* and 22*b*, so that electrical connection is established between the conductive member 30 and the ground contacts 22*a* and 22*b*.

At this point, the pair of locking projections 32 of the conductive member 30 are press-fitted against the lateral surfaces of the receiving hole 12, and the pair of guide projections 14*a* is each press-fitted between the upper and lower locking projections 4111 formed in each of the paired guide recesses 411 of the lead connection assisting member 40. As a result, the leading end portion of the conductive member 30 is received and securely placed in position in the receiving hole 12 in the housing 10, and the leading end portion is interposed between the middle portions (of the signaling contacts 21*a* and of the ground contacts 22*a*) and the middle portions (of the signaling contacts 21*b* and of the ground contacts 22*b*). Also, the lead connection assisting member 40 is securely attached to the rear end of the housing 10.

Further, the signaling contacts 21*a* and the ground contacts 22*a* that project out of the rear surface of the main body of the housing 10 are received in the first guide grooves 431*a* of the lead connection assisting member 40 to be disposed on the first support table 43*a*. Similarly, the signaling contacts 21*b* and the ground contacts 22*b* are received in the second guide grooves 431*b* of the lead connection assisting member 40 to be disposed on the second support table 43*b*.

After that, the cores c11 are taken from the leading ends of the lead wires c1 of the cable c. The leading ends of the lead wires c1 are press-fitted into the first and second lead insertion grooves 421*a* and 421*b* in the lead connection assisting member 40, and the cores c11 of the lead wires c1 are placed on the first and second support tables 43*a* and 43*b*.

Then, collective soldering by a pulse heating method etc. is performed on the first support table 43*a* to connect the signaling contacts 21*a* and the ground contacts 22*a* with the cores c11 of the lead wires c1, and also on the second support table 43*b* to connect the signaling contacts 21*b* and the ground contacts 22*b* with the cores c11 of the lead wires c1. After soldering, the rear end portion of the conductive member 30 is located below the rear end portions of the signaling contacts 21*a* and of the ground contacts 22*a* and the cores c11 soldered thereto, and above the rear end portions of the signaling contacts 21*b* and of the ground contacts 22*b* and the cores c11 soldered thereto.

The housing 10 in this state is inserted into the shield cover 50. The case 60 is then molded over the proximal end of the shield cover 50.

The electrical connector thus assembled is used in the following manner. First, the connecting protrusion R1 of the receptacle connector R is inserted into the opening 11 in the electrical connector. As shown in FIG. 8, the inserted connection protrusion R1 presses upward the leading ends of the signaling contacts 21*a* and of the ground contacts 22*a* of the electrical connector into elastic contact with the upper contacts R11. Simultaneously, the connection protrusion R1 presses downward the leading ends of the signaling contacts 21*b* and of the ground contacts 22*b* into elastic contact with the lower contacts R12. As a result, the lead wires c1 and the signaling contacts 21*a* and 21*b* are electrically connected with an electrode pattern on a circuit board of the electronic instrument or the like through the intermediary of the upper and lower signaling contacts R11 and R12, and the conductive member 30 and the ground contacts 22*a* and 22*b* are electrically connected with a ground pattern on the board through the intermediary of upper and lower ground contacts R11 and R12.

In the electrical connector as described above, simply inserting the conductive member 30 into the receiving hole 12 in the housing 10 brings the cut-and-raised pieces 31*a* and 31*b* of the conductive member 30 into contact with the ground contacts 22*a* and 22*b*. Hence, when the electrical connector is coupled to the receptacle connector R and the ground contacts 22*a* and 22*b* contact the upper and lower ground contacts R11 and R12, respectively, the conductive member 30 and the ground contacts 22*a* and 22*b* are connected to the ground pattern on the circuit board at the same time. Accordingly, it is possible to ground the conductive member 30 without providing the housing 10 as a two-piece structure and without boring guiding holes in the housing 10, so that the electrical connector can be simplified in structure.

Further, crosstalk is less likely to occur between the middle portions of the signaling contacts 21*a* and the middle portions of the signaling contacts 21*b* because the leading end portion of the conductive member 30 is received in the receiving hole 12 in the housing 10 to be interposed between the middle portions of the signaling contacts 21*a* and of the ground contacts 22*a* and the middle portions of the signaling contacts 21*b* and of the ground contacts 22*b*. In addition, the rear end portion of the conductive member 30 is fittingly received in the attachment hole 44 in the lead connection assisting member 40 so as to be interposed in the space below the rear end portions of the signaling contacts 21*a* and of the ground contacts 22*a* as well as the cores c11 of the upper lead wires c1 that are soldered to these rear end portions, and above the rear end portions of the signaling contacts 21*b* and of the ground contacts 22*b* as well as the cores c11 of the lower lead wires c1 that are soldered to these rear end portions. Hence, the rear end portion of the conductive member 30 also serves to reduce crosstalk between the rear end portions of the signaling contacts 21*a* as well as the cores c11 of the upper lead wires c1 and the rear end portions of the signaling contacts 21*b* as well as the cores c11 of the lower lead wires c1. Moreover, each ground contact 22*a* is disposed among a predetermined number of signaling contacts 21*a*, and each ground contact 22*b* is also disposed among a predetermined number of signaling contacts 21*b*, thereby reducing crosstalk among the signaling contacts 21*a* and among the signaling contacts 21*b*.

Furthermore, crosstalk can be further reduced by electrically connecting the cut-and-raised pieces 31*a* and 31*b* of the conductive member 30 to the ground pattern on the board through the ground contacts 22*a* and 22*b*. Most suitable ground connection can be given to each kind of electrical connector by changing the positions and/or number of the ground contacts 22*a* and 22*b*.

Further advantageously, the first and second lead insertion grooves 421*a* and 421*b* in the lead connection assisting member 40 allow the leading ends of the lead wires c1 of the cable c to be temporarily held on the back side of the housing 10. In this state, a single collective soldering using a pulse heating method or the like is made to connect the cores c11 that are taken from the leading ends of the lead wires c1 with the rear end portions of the signaling contacts 21*a* and 21*b* and of the ground contacts 22*a* and 22*b* that project out of the rear surface of the housing 10, supported on the first and second support tables 43*a* and 43*b* of the lead connection assisting member 40. It is thus advantageously easy to assemble the electrical connector, leading to improved mass productivity.

The barbs 422*a* and 422*b* serves not only to prevent the leading ends of the lead wires c1 of the cable c from readily slipping out of the first and second lead insertion grooves 421*a* and 421*b* but also to hold the leading ends of the lead wires c1 that are press-fitted in the first and second lead insertion grooves 421*a* and 421*b*. Thus, the leading ends of the lead wires c1 are reliably located on the lead connection assisting member 40 and can be accordingly soldered with extremely high accuracy. The present electrical connector thus offers outstanding performance because of its improved transmission characteristics.

Further, the conductive member 30 received in the receiving hole 12 of the housing 10 serves to protect the housing 10 from distortion. The pair of guide plates 14 of the housing 10 is also reinforced by placing the lead connection assisting member 40 between the guide plates 14. The mechanical strength of the entire electrical connector is thus improved, hence enabling downsizing of the electrical connector.

Embodiment 2

Figure 9:
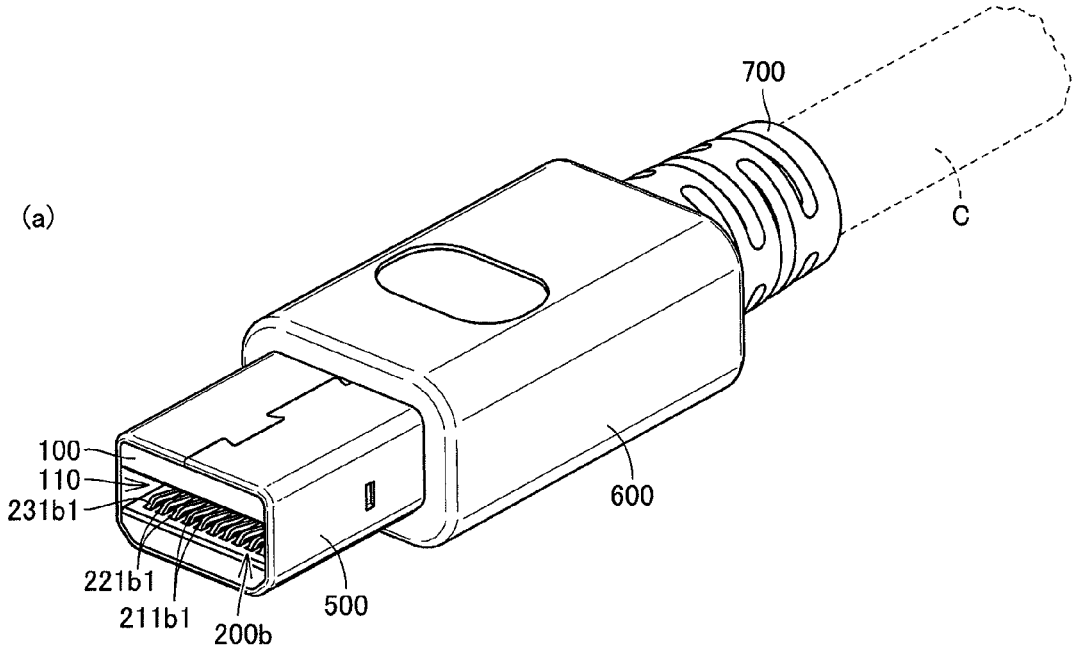
FIGS. 9(*a*) and 9(*b*) are perspective schematic views of an electrical connector according to Embodiment 2 of the present invention, wherein FIG. 9(*a*) is a view as seen from the front-top-right side, and FIG. 9(*b*) is a view as seen from the front-bottom-left side.
Figure 9:
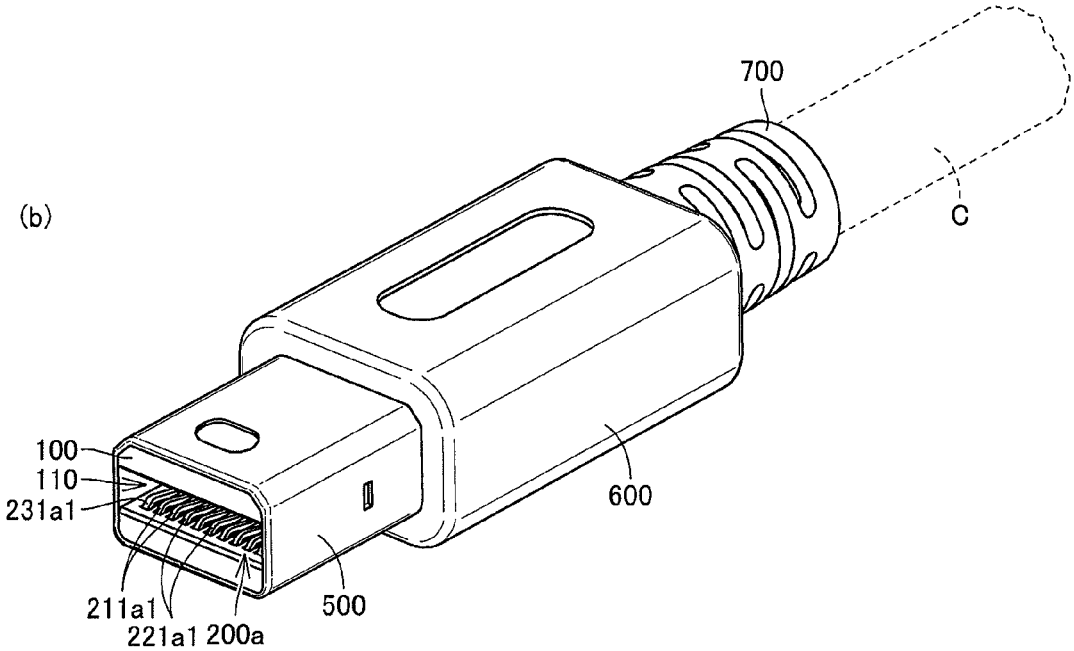
Figure 10:
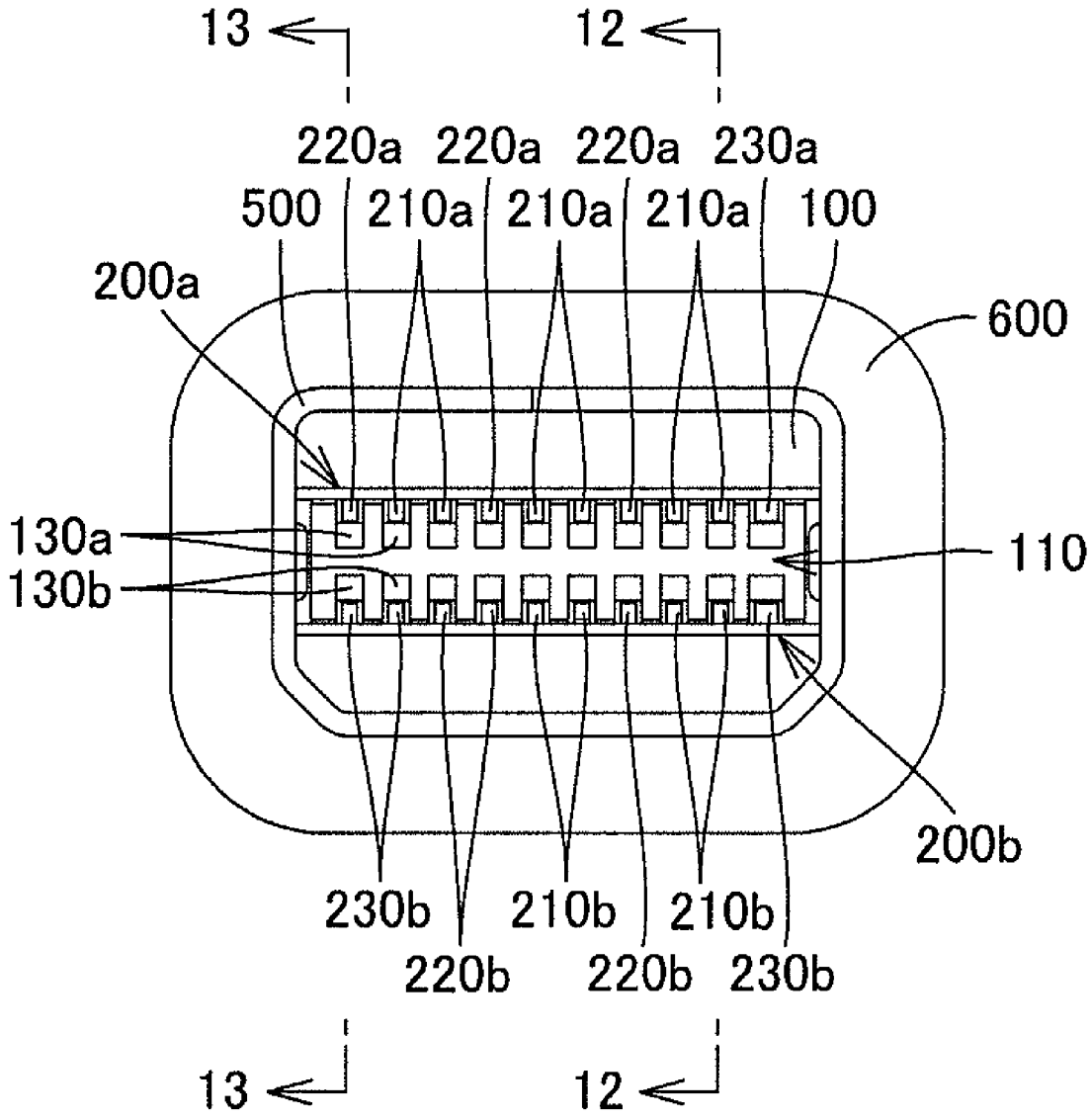
FIG. 10 is a front schematic view of the connector.
Figure 11:
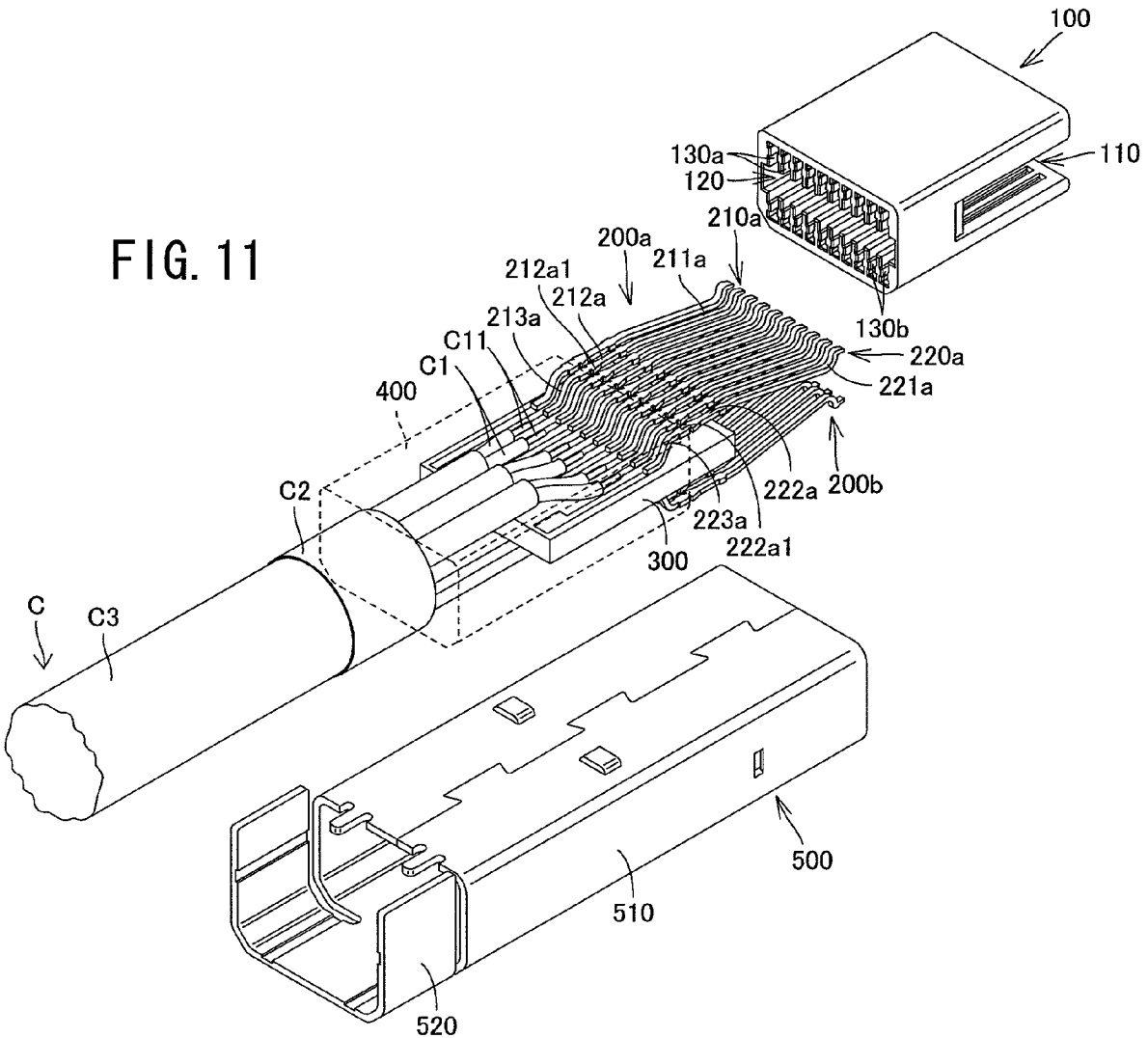
FIG. 11 is an exploded perspective schematic view of the connector excluding a case and a bush.
Figure 12:
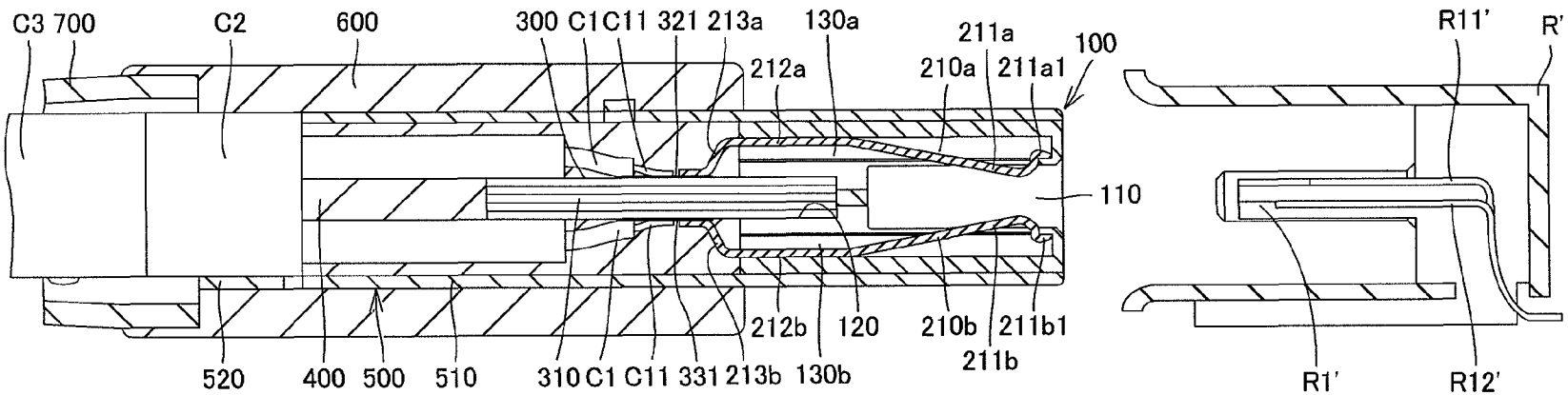
FIG. 12 is a cross-sectional schematic view of the connector, taken along line 12-12 in FIG. 10.
Figure 13:
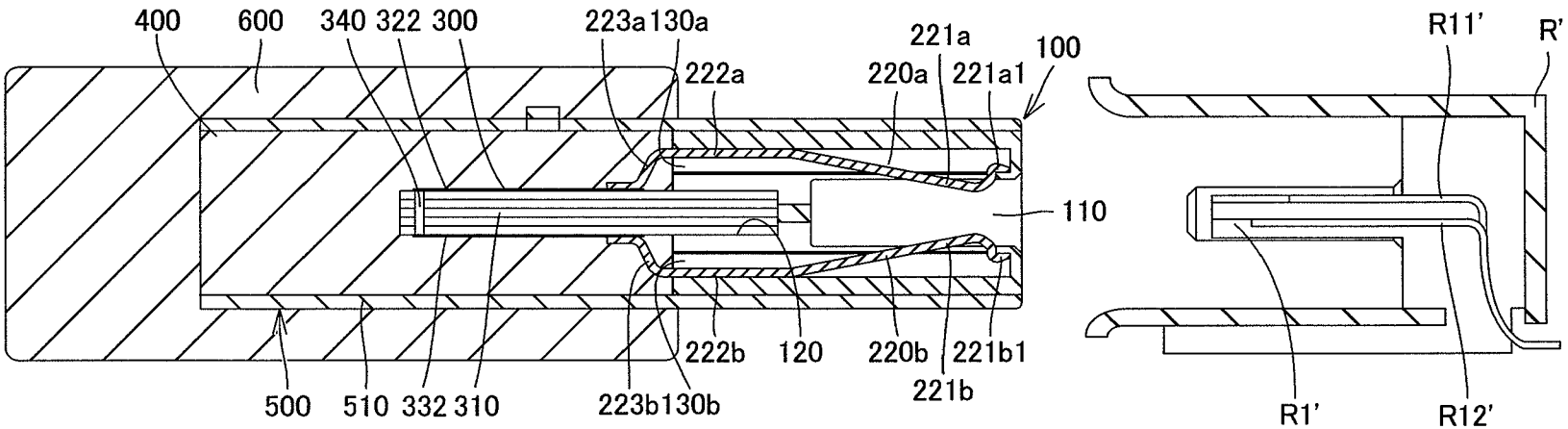
FIG. 13 is a cross-sectional schematic view of the connector, taken along line 13-13 in FIG. 10.
Figure 14:
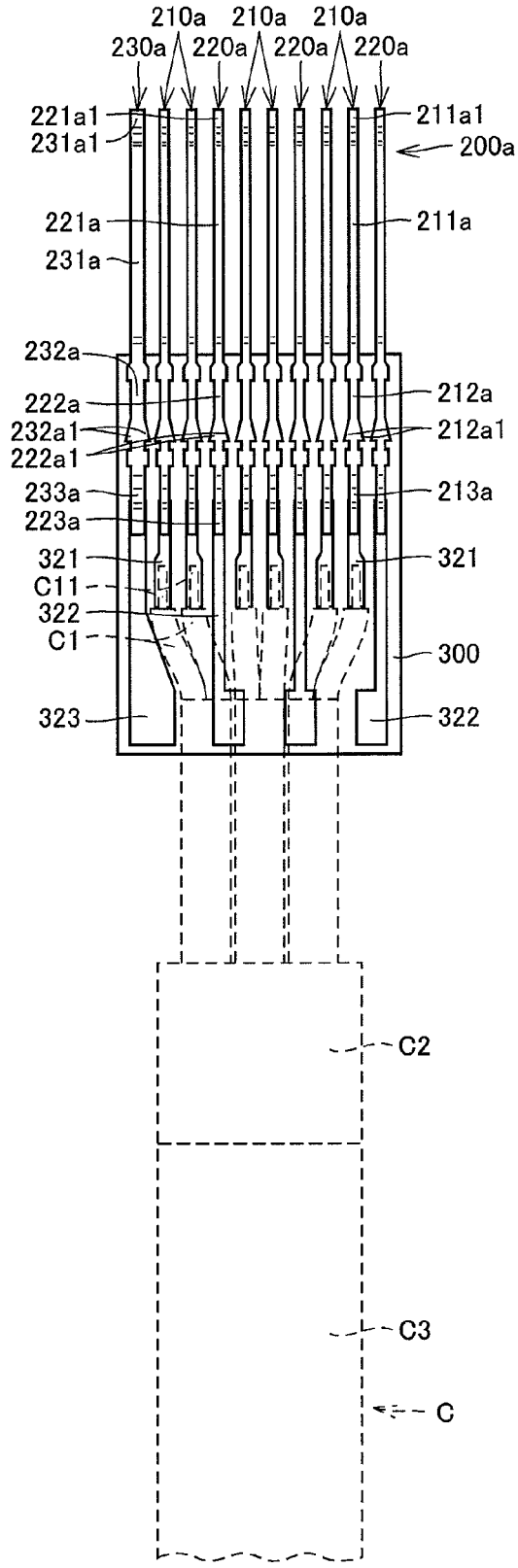
FIG. 14 is a plan schematic view illustrating connected multilayer board, contacts and lead wires of the connector.
Figure 15:
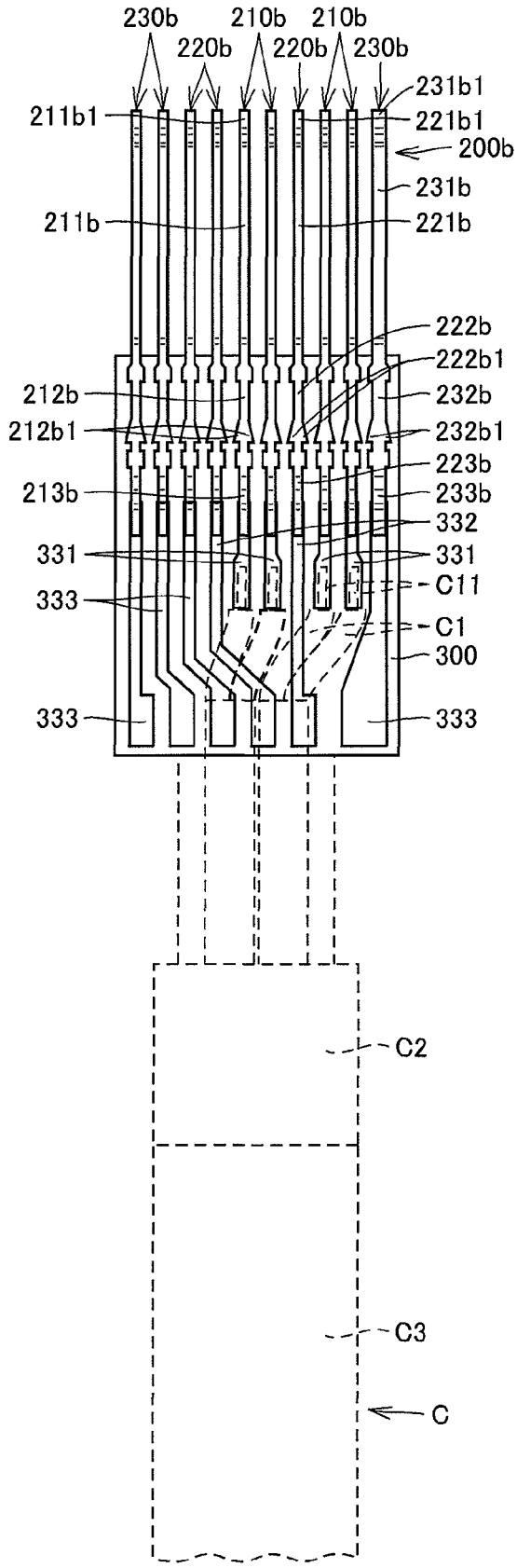
FIG. 15 is a bottom schematic view illustrating the connected multilayer board, contacts and lead wires of the connector.

Next, an electrical connector according to Embodiment 2 of the present invention is described with reference to FIGS. 9(*a*) to 15. FIGS. 9(*a*) and 9(*b*) are perspective schematic views of the electrical connector according to Embodiment 2 of the present invention, wherein FIG. 9(*a*) is a view as seen from the front-top-right side, and FIG. 9(*b*) is a view as seen from the front-bottom-left side. FIG. 10 is a front schematic view of the connector, and FIG. 11 is an exploded perspective schematic view of the connector excluding a case and a bush. FIG. 12 is a cross-sectional schematic view of the connector, taken along line 12-12 of FIG. 10, FIG. 13 is a cross-sectional schematic view of the connector, taken along ling 13-13 of FIG. 10, FIG. 14 is a plan schematic view illustrating connected multilayer board, contacts and lead wires of the connector, and FIG. 15 is a bottom schematic view illustrating the connected multilayer board, contacts and lead wires of the connector.

The electric connector shown in FIGS. 9(*a*) to 11 is a plug connector referred to as DisplayPort, adapted for attachment to a leading end of a bulk cable c for use in high speed signaling. The electrical connector includes a housing 100, first and second contact groups 200*a* and 200*b*, a multilayer circuit board 300, a block 400, a shield cover 500, a case 600, and a bush 700. Each component of the connector will be described below in detail.

As shown in FIGS. 9(*a*) to 12, the housing 100 is a molded article of insulative resin having a laterally-faced U shape in cross-sectional view. A recess 110 is formed in a leading end of the housing 100. The recess 110 is a substantially rectangular recess to receive a connecting protrusion R1' of a receptacle connector R' of an electronic instrument or the like. The rear end of the housing 100 has a receiving hole 120 communicating with the recess 110. The receiving hole 120 is a generally rectangular hole to receive the multilayer circuit board 300.

Moreover, as shown in FIGS. 10 and 11, a plurality of upper and lower contact containing grooves 130*a* and 130*b* are formed at predetermined intervals above and below, respectively, the recess 110 and the receiving hole 120 of the housing 100. The upper and lower contact containing grooves 130*a*, 130*b* are elongated recesses extending in a longitudinal direction of the housing 100 and communicating with the recess 110 and the receiving hole 120. As shown in FIGS. 10 and 11, the upper contact containing grooves 130*a* and the lower contact containing grooves 130*b* are arranged at equal pitch distance to each other. The pitch distance of the upper and lower contact containing grooves 130*a*, 130*b* is equal to that of a plurality of upper and lower contacts R11', R12' provided on upper and lower surfaces of a connecting protrusion R1' of a receptacle connector R'.

As shown in FIGS. 10 to 15, the first contact group 200*a* includes a plurality of signaling contacts 210*a*, ground contacts 220*a* and another contact 230*a*. The signaling contacts 210*a*, the ground contacts 220*a*, and the contact 230*a* are substantially the same metal terminals. The signaling contacts 210*a*, the ground contacts 220*a*, and the contact 230*a* have rectilinear middle portions 212*a*, 222*a* and 232*a*, respectively. Paired press fitting pieces 212*a*1, 222*a*1, 232*a*1 project laterally from opposite lateral ends of the middle portions 212*a*, 222*a* and 232*a*, respectively. Each width dimension of the middle portions 212*a*, 222*a*, 232*a* including the press fitting pieces 212*a*1, 222*a*1, 232*a*1 is slightly larger than the width dimension of each upper contact containing grooves 130*a*. That is, by press-fitting the middle portions 212*a*, 222*a*, 232*a* into the upper contact containing grooves 130*a*, the signaling contacts 210*a*, the ground contacts 220*a* and the contact 230*a* are arranged in laterally side by side relation inside the housing 100. The contact 230*a* may be used as a ground, power supply or low speed signaling contact.

Leading ends 211*a*, 221*a*, 231*a* of the signaling contacts 210*a*, the ground contacts 220*a* and the contact 230*a* are bent in generally V-shape and are continued to longitudinal ends of the middle portions 212*a*, 222*a* and 232*a*. The distal ends of the leading ends 211*a*, 221*a* and 231*a* are provided with generally circular-arc contact point portions 211*a*1, 221*a*1 and 231*a*1. The contact point portions 211*a*1, 221*a*1, 231*a*1 project from the upper contact containing grooves 130*a* into the recess 110 of the housing 100 so as to be contactable with the upper contacts R11' of the receptacle connector R'.

Rear end portions 213*a*, 223*a* and 233*a* of the signaling contacts 210*a*, the ground contacts 220*a*, and the contact 230*a* are bent in a substantially L shape and are continued to the longitudinal other ends of the middle portions 212*a*, 222*a* and 232*a*. The rear end portions 213*a*, 223*a*, 233*a* are to contact upper signaling conductors 321, upper ground conductors 322 and another conductor 323 of the multilayer circuit board 300 to be soldered thereto.

As shown in FIGS. 10 and 15, the second contact group 200*b* also includes a plurality of signaling contacts 210*b*, ground contacts 220*b* and other contacts 230*b*. The signaling contacts 210*b*, the ground contacts 220*b* and the contacts 230*b* are the same except that middle portions 212*b*, 222*b* and 232*b* are press-fitted into the lower contact containing grooves 130*b* to be arrayed laterally in the housing 10 in a different line from that of the first contact group 200*a*. Accordingly, overlapping descriptions are not given here. The contacts 230*b* may also be used as ground, power supply, low speed signaling contacts.

The multilayer circuit board 300 is a well-known multilayer board having each conductor layer interposed between insulating layers. As shown in FIGS. 12 and 13, a leading end of the multilayer circuit board 300 is received in the receiving hole 120 in the housing 100. One of the inner conductor layers of the multilayer circuit board 300 is a solid conductor layer 310 that is a conductor such as a copper foil extending in the substantially entire region of the multilayer circuit board 300. Moreover, as shown in FIG. 14, on an upper surface of the multilayer circuit board 300, there are provided with upper signaling conductors 321, upper ground conductors 322 and another conductor 323. The upper signaling conductors 321 are printed conductive traces located in a middle portion of the multilayer circuit board 300. The upper ground conductors 322 and the conductor 323 are printed conductive traces extending from the middle portion of the multilayer circuit board 300 to a rear end thereof. As shown in FIG. 15, on a lower surface of the multilayer circuit board 300, there are provided with lower signaling conductors 331, lower ground conductors 332, and other conductors 333. The lower signaling conductors 331 are printed conductive traces located below the middle portion of the multilayer circuit board 300. The lower ground conductors 332 and the conductors 333 are printed conductive traces extending from the middle portion of the multilayer circuit board 300 to the rear end thereof. As shown in FIG. 13, a plurality of through-holes 340 (i.e., penetrating via-holes) are provided inside the multilayer circuit board 300 to connect the solid conductor layer 310 with the upper ground conductors 322 and the lower ground conductors 332. The conductors 323, 333 may be used as ground, power supply, or low speed signaling conductors.

As shown in FIGS. 12 and 14, the upper signaling conductors 321 are connected by soldering to the rear end portions 213*a* of the first row contact group 200*a* and to the cores c11 taken from the plurality of lead wires c1 incorporated in the cable c. As shown in FIGS. 13 and 14, the upper ground conductors 322 are connected by soldering to the rear end portions 223*a* of the first contact group 200*a*, and to cores for grounding (not shown) taken from the cable c. The conductor 323 is connected by soldering to the rear end 233*a* of the first contact group 200*a* to a core for grounding, power supply, low speed signaling or some other purpose (not shown) taken from the cable c. As shown in FIGS. 12 to 15, the lower signaling conductors 331 are connected by soldering to the rear end portions 213*b* of the second contact group 200*b* and to the cores c11 of the lead wires c1 of the cable c. As shown in FIGS. 13 and 15, the lower ground conductors 332 are connected by soldering to rear end portions 223*b* of the second contact group 200*b* and to cores for grounding (not shown) taken from the cable c. The conductors 333 are connected by soldering to the rear end portions 233*b* of the second contact group 200*b* and to the cores for grounding, power supply, low speed signaling or some other purpose (not shown) taken from the cable c. The state where the rear end portions 213*a*, 223*a*, 233*a*, 213*b*, 223*b* and 233*b* are soldered as described above is hereinafter referred to as a "soldered state". When the rear end portions 223*a* of the ground contacts 220*a* are connected to the upper ground conductors 322, and the rear end portions 223*b* of the ground contacts 220*b* are connected to the lower ground conductors 332, ground connection is established for the solid conductor layer 310.

In the soldered state, as shown in FIGS. 12 and 13, the leading end of the multilayer circuit board 300 is interposed between the middle portions 212*a*, 222*a*, 232*a* of the first contact group 200*a* and the middle portions 212*b*, 222*b*, 232*b* of the second contact group 200*b*; and the middle portion of the multilayer circuit board 300 is interposed between the rear end portions 213*a*, 223*a*, 233*a* of the first contact group 200*a* and the rear end portions 213*b*, 223*b*, 233*b* of the second contact group 200*b*. That is, a leading end (i.e., a portion on the leading end side) of the solid conductor layer 310 is interposed between the middle portions 212*a*, 222*a*, 232*a* of the first contact group 200*a* and the middle portions 212*b*, 222*b*, 232*b* of the second contact group 200*b*, so that the leading end of the solid conductor layer 310 serves as a first crosstalk reducer to reduce crosstalk between the middle portions 212*a* of the first contact group 200*a* and the middle portions 212*b* of the second contact group 200*b*. Also, a middle portion (i.e., a portion closer to the rear end side than the leading end) of the solid conductor layer 310 is interposed between the rear end portions 213*a*, 223*a*, 233*a* of the first contact group 200*a* and the rear end portions 213*b*, 223*b*, 233*b* of the second contact group 200*b*, so that the middle portion of the solid conductor layer 310 serves as a second crosstalk reducer to reduce crosstalk between the rear end portions 213*a* of the first contact group 200*a* and the rear end portions 213*b* of the second contact group 200*b*.

The block 400 is a rectangular parallelepiped molded article of insulating resin as shown in FIGS. 11 to 13. Embedded inside the block 400 are the multilayer circuit board 300 excluding the leading end thereof, the rear end portions 213*a*, 223*a*, 233*a* of the first contact group 200*a* soldered to the upper signaling conductors 321, the upper ground conductors 322 and the conductor 323 of the multilayer circuit board 300, the rear end portions 213*b*, 223*b*, 233*b* of the second contact group 200*b* soldered to the lower signaling conductors 331, the lower ground conductors 332 and the conductors 333 of the multilayer circuit board 300, the leading ends of the lead wires c1 whose cores c11 are soldered to the upper signaling conductors 321 and the lower signaling conductors 331, and leading ends of the lead wires whose cores are connected to the upper ground conductors 322 and the lower ground conductors 332.

As shown in FIG. 11, the shield cover 500 includes a rectangular tuboid shell 510, and a generally U-shaped ground connecting portion 520 provided continuously to a rear end of the shell 510. The shell 510 is formed by bending a flat metal plate into a rectangular tuboid shape so as to cover peripheral surfaces of the housing 100 and the block 400. The leading end portion of the ground connecting portion 520 has outer end portions bent inward so as to contact a shield conductor c2, which covers the lead wires c1 and is exposed from an outer insulator c3 of the cable c. This allows the ground connecting portion 520 to be connected to the shield conductor c2. The shield cover 500 is thus grounded through the shield conductor c2 of the cable c.

As shown in FIGS. 9(*a*) and 9(*b*), the bush 700 is a tuboid body fitting around the ground connecting portion 520 of the shield cover 500 connected to the shield conductor c2 in the cable c. The case 600 is a generally rectangular parallelepiped molded body of insulating resin as shown in FIGS. 9(*a*) and 9(*b*). Embedded inside the case 600 are the shell 510 excluding its leading end, which covers the housing 100 and the block 400, and the leading end of the bush 700.

The electrical connector having the above-described configuration is assembled in the following steps. First, the signaling contacts 210*a*, the ground contacts 220*a* and the contact 230*a* of the first contact group 200*a* are inserted into the respective upper contact containing grooves 130*a* of the housing 100 from the rear side, and the middle portions 212*a*, 222*a*, 232*a* of the signaling contacts 210*a*, the ground contacts 220*a* and the contact 230*a* are press-fitted in the respective upper contact containing grooves 130*a*. Similarly, the signaling contacts 210*b*, the ground contacts 220*b* and the contacts 230*b* of the second contact group 200*b* are inserted into the respective lower contact containing grooves 130*b*, and the middle portions 212*b*, 222*b*, 232*b* of the signaling contacts 210*b*, the ground contacts 220*b*, and the contacts 230*b* are press-fitted into the respective lower contact containing grooves 130*b*.

Thereafter, the multilayer circuit board 300 is inserted into the receiving hole 120 in the housing 100. Upon this insertion, the rear end portions 213*a*, 223*a*, 233*a* of the signaling contacts 210*a*, the ground contacts 220*a*, and the contact 230*a* are brought into contact with the upper signaling conductors 321, the upper ground conductors 322, and the conductor 323 of the multilayer circuit board 300, and the rear end portions 213*b*, 223*b*, 233*b* of the signaling contacts 210*b*, the ground contacts 220*b*, and the contacts 230*b* are brought into contact with the lower signaling conductors 331, the lower ground conductors 332, and the conductors 333 of the multilayer circuit board 300, respectively. In this state, the rear end portions 213*a*, 223*a*, 233*a* are soldered to the upper signaling conductors 321, the upper ground conductors 322, and the conductor 323, respectively, and the rear end portions 213*b*, 223*b*, 233*b* are soldered to the lower signaling conductors 331, the lower ground conductors 332, and the conductors 33, respectively.

Thereafter, the cores c11 of the lead wires c1 of the cable c are soldered to the upper signaling conductors 321 and the lower signaling conductors 331. The cores of the cable c are soldered to the upper ground conductors 322 and the lower ground conductors 332.

In this state, insulating resin is molded embedding the multilayer circuit board 300 excluding its leading portion, the rear end portions 213*a*, 223*a*, 233*a* of the first contact group 200*a* soldered to the upper signaling conductors 321, the upper ground conductors 322, and the conductor 323 of the multilayer circuit board 300, the rear end portions 213*b*, 223*b*, 233*b* of the second contact group 200*b* soldered to the lower signaling conductors 331, the lower ground conductors 332, and the conductors 333 of the multilayer circuit board 300, the leading ends of the lead wires c1 whose cores c11 are soldered to the upper signaling conductors 321 and the lower signaling conductors 331, and the leading ends of the lead wires whose cores are connected to the upper ground conductors 322 and the lower ground conductors 332. This molded insulating resin forms the block 400.

Thereafter, the flat plate-like shell 510 of the shield cover 500 is bent to cover the housing 100 and the block 400. The shell 510 is thereby formed into a rectangular tuboid shape. Then the ground connecting portion 520 of the shield cover 500 is bent to cover the shield conductor c2 of the cable c. At this time, the ground connecting portion 520 is brought into contact with the shield conductor c2.

Thereafter, the cable c is inserted into the bush 700 to fit over the ground connecting portion 520. In this state, the shell 510 excluding its leading end and the leading end of the bush 700 are molded with insulating resin to be embedded in the insulating resin. This insulating resin forms the case 600.

The electrical connector thus assembled is used in the following manner. First, the connecting protrusion R1' of the receptacle connector R' is inserted into the recess 110 of the electrical connector. Then the inserted connecting protrusion R1' presses upward the contact point portions 211*a*1, 221*a*1, 231*a*1 of the signaling contacts 210*a*, the ground contacts 220*a* and the contact 230*a* of the electrical connector into elastic contact with the upper contacts R11'. Simultaneously, the connecting protrusion R1' presses downward the contact point portions 211*b*1, 221*b*1, 231*b*1 of the signaling contacts 210*b*, the ground contacts 220*b* and the contacts 230*b* into elastic contact with the lower contacts R12'. As a result, the lead wires c1 and the signaling contacts 210*a*, 210*b* are connected to an electrode pattern on the circuit board of the electronic instrument or the like through the upper and lower signal contacts R11', R12', while the solid conductor layer 310, the through holes 340, the upper ground conductors 322, the lower ground conductors 332, and the ground contacts 220*a*, 220*b* are connected to a ground pattern on the circuit board of the electronic instrument or the like through the upper and lower ground contacts R11', R12'.

In the above-described electrical connector, it is possible to ground the solid conductor layer 310 of the multilayer circuit board 300 simply by inserting the multilayer circuit board 300 into the receiving hole 120 of the housing 100, and by contacting and soldering the rear end portions 223*a* of the first contact group 200*a* to the upper ground conductors 322 of the multilayer circuit board 300, and contacting and soldering the rear end portions 223*b* of the second contact group 200*b* to the lower ground conductors 332 of the multilayer circuit board 300. Accordingly, it is possible to ground the solid conductor layer 310 without providing the housing 100 in a two-piece structure or boring guiding holes in the housing 100, so that the electrical connector can be simplified in structure.

Moreover, the leading end of the multilayer circuit board 300 is inserted into the receiving hole 120 in the housing 100, so that the leading end of the solid conductor layer 310 of the multilayer circuit board 300 is interposed between the middle portions 212*a*, 222*a*, 232*a* of the first contact group 200*a* and the middle portions 212*b*, 222*b*, 232*b* of the second contact group 200*b*. Consequently, the leading end of the solid conductor layer 310 serves to reduce crosstalk between the middle portions 212*a* of the signaling contacts 210*a* and the middle portions 212*b* of the signalizing contacts 210*b*. Moreover, the middle portion of the multilayer circuit board 300 is interposed between the rear end portions 213*a*, 223*a*, 233*a* of the first contact group 200*a* and the rear end portions 213*b*, 223*b*, 233*b* of the second contact group 200*b*. Consequently, the middle portion of the solid conductor layer 310 serves to reduce crosstalk between the cores c11 of the upper lead wires c1, soldered to the rear end portions 213*a* of the signaling contacts 210*a* and to the upper signaling conductors 321, and the cores c11 of the lower lead wires c1, soldered to the rear end portions 213*b* of the signaling contacts 210*b* and the lower signaling conductors 331. Furthermore, as the ground contacts 220*a* are interposed between the signaling contacts 210*a* and the ground contacts 220*b* are interposed between the signaling contacts 210*b*, crosstalk is less likely to occur between the signaling contacts 210*a* and between the signaling contacts 210*b*.

In addition, crosstalk can be further reduced by connecting the solid conductor layer 310 of the multilayer circuit board 300 to the ground patterns on the circuit board of the above-described electronic instrument or the like through the ground contacts 220*a*, 220*b*. Most suitable ground connection can be given to each kind of electrical connector by changing the positions and/or number of the ground contacts 220*a*, 220*b*, or by adjusting the region of the solid conductor layer 310.

Moreover, the block 400 allows the cores c11 of the lead wires c1 to be retained in the soldered state to the upper signaling conductors 321 and the lower signaling conductors 331, preventing inadvertent disconnection of the cores c11 of the lead wires c1 from the upper signaling conductors 321 and the lower signaling conductors 331 even when external force is applied.

Furthermore, the multilayer circuit board 300 received in the receiving hole 120 in the housing 100 serves to protect the housing 100 from distortion. The mechanical strength of the entire electrical connector is thus improved, hence enabling downsizing of the electrical connector.

The above-described electrical connectors may be modified without departing from the scope of the claims. Possible modifications to each component are described in detail below.

The housings 10, 100 may be modified appropriately as long as the housings 10, 100 have at least one receiving hole and allow first and second contact groups to be arranged on opposite sides of the receiving hole. It is therefore possible to provide two or more receiving holes in the housing for arranging therein three or more rows of contact groups. The first and second contact groups may be embedded on opposite sides of the receiving hole of the housing.

In Embodiment 1, the guide projections 14*a* are provided on the inner surfaces of the paired guide plates 14, but it is also possible to provide guide recesses. In this case, guide projections may be provided on the opposite ends of the base 41 of the lead connection assisting member 40. The guide plates 14 may be omitted or may have any other shape other than the plate-like shape. In this case, the lead connection assisting member 40 can be attached to the rear end of the housing 10 by other means, e.g., by fitting the conductive member 30 into the receiving hole 12 in the housing 10.

Any kind of conductive member 30 may be used as long as it is received in an receiving hole in the housing to be contactable with ground contacts of the first and second contact groups. For example, the conductive member may be fabricated by coating non-conductive material, such as synthetic resin, with metal by vapor deposition or some other method.

In Embodiment 1, the leading end portion of the conductive member 30 serves as the first crosstalk reducer and the rear end portion thereof serves as the second crosstalk reducer, but the present invention is not limited thereto. For example, the entire conductive member 30 may be the first crosstalk reducer. In this case, the leading end portion of the conductive member 30 is extended up to a position between the leading ends of the signaling contacts of the first and second contact groups.

In Embodiment 1, the conductive member 30 has the cut-and-raised pieces 31*a* and 31*b* serving as a grounding portion to contact the ground contacts, but the present invention is not limited thereto. For example, the grounding portion may be a plate-like conductive member having a convex metal body welded thereto, or may be the aforementioned non-conductive member provided with a projection coated with metal, or may be electrical connecting means such as a lead wire that connects the conductive member or the metal with a ground contact. It is also possible to omit the grounding portion from the conductive member and instead bring the main body of the conductive member into direct contact with the ground contact.

The conductive member 30 only needs to contact at least one ground contact of the first and second contact groups. The conductive member of course may be connected to all ground contacts of the first and second contact groups.

The cut-and-raised pieces 31*a* and 31*b* may have increased resilience, placing more weight on grounding. For example, the cut-and-raised pieces may have a smaller width dimension than the width dimension of the openings that are left in the conductive member after the cut-and-raised pieces are cut out therefrom, so that the cut-and-raised pieces are elastically deformable upward and downward, provided that the crosstalk reducing effect of the conductive member 30 is not affected.

It is optional whether to provide the paired locking projections 32 on opposite lateral ends of the conductive member 30, serving as the first locking means, as in Embodiment 1. The first locking means need not be provided on the conductive member 30, and it may be provided as a locking projection on a lateral surface of the receiving hole 12 in the housing 10. The first locking means may be provided both on the conductive member and on the lateral surfaces of the receiving hole 12 in the housing 10. Any other well-known locking means, such as a combination of a locking projection and a locking recess, may be employed.

Moreover, the present invention is not limited to Embodiment 2 wherein the upper ground conductors 322 and the lower ground conductors 332 are provided on the upper and lower surfaces of the multilayer circuit board 300. That is, a surface of the multilayer board should be provided with any one of the upper ground conductors 322 and the lower ground conductors 332 so as to be contactable with the ground contacts.

The solid conductor layer 310 of Embodiment 2 is conductive material spreading throughout the multilayer circuit board 300, but the present invention is not limited thereto. In other words, the solid conductor layer 310 may be provided in a partial region of an inner layer of the multilayer circuit board 300. In this case as well, the solid conductor layer can be interposed between the signaling contacts 210*a* and the signaling contacts 210*b* to reduce the crosstalk therebetween.

The multilayer circuit board 300 of Embodiment 2 has the through holes 340 penetrating the multilayer circuit board 300, but the present invention is not limited thereto. As via holes other than the through holes 340, it is possible to use interstitial via holes connecting the solid conductor layer 310 and the upper ground conductors 322 or the lower ground conductors 332.

It is optional to provide the upper signaling conductors 321 and the lower signaling conductors 331 on the upper and lower surfaces of the multilayer circuit board 300 as in Embodiment 2. For example, the upper signaling conductors 321 and the lower signaling conductors 331 may be omitted when the cores c11 of the lead wires c1 of the cable c are directly soldered to the signaling contacts 210*a*, 210*b*. Moreover, the present invention is not limited to Embodiment 2 where the cores of the cable c are soldered to the upper ground conductors 322 and the lower ground conductors 332. For example, the cores may be directly soldered to the ground contacts 220*a*, 220*b*. Moreover, the cores of the cable c may not be soldered to the upper ground conductors 322, the lower ground conductors 332, or the ground contacts 220*a*, 220*b*.

Further, the present invention encompasses an electrical connector having a conductive member and a multilayer board that are received in a receiving hole in the housing. In other words, while molding the housing, the conductive member and the multilayer board may be embedded in the housing by means of insert molding or some other process. In this case also, ground connection can be easily provided only by bringing the conductive member and the multilayer board into contact with a ground contact. The conductive member need not be attached to the lead connection assisting member, and these members may be provided separately.

If providing three or more rows of contact groups, two or more conductive members 30, multilayer boards 300 may be provided and may be each disposed between the rows of contact groups.

The signaling contacts in Embodiments 1 and 2 are directly or indirectly soldered at their rear end portions to the cores of the lead wires, but the present invention is not limited thereto. As later described in detail, when the electrical connector is a plug connector other than the type having a cable connected thereto, or a receptacle connector, the rear end portions of the contacts may be connected to conductors or other connection objects of a circuit board of an electronic instrument or the like. Moreover, as to the ground contacts, at least one should be included in the first and second contact groups. In the above-described contacts, portions other than the rear end portions can be used as connecting portions for connection with the conductors of the cable or the multilayer board.

The lead connection assisting member 40 may be appropriately modified, provided the lead connection assisting member includes first and second support tables for supporting the rear end portions of signaling contacts of first and second contact groups and cores taken from the leading ends of lead wires so that soldering of the contact rear end portions with the cores can be performed on the support tables, the assisting member also including, on the rear end sides of the first and second support tables, a plurality of first and second lead insertion grooves that are arranged at equal pitch intervals to the pitch intervals of the signaling contacts of the first and second contact groups, for receiving and temporarily holding the leading ends of the lead wires. The lead connection assisting member 40 may be omitted, and particularly if the electrical connector is a plug connector which is not of a type involving cable connection, or a receptacle connector, as described later.

The first and second lead insertion grooves 421*a* and 421*b* may be appropriately modified into any shape adapted to receive and position lead wires. The same holds true for the first and second guide grooves 431*a* and 431*b*. The first and second guide grooves 431*a* and 431*b* may be omitted.

The present invention is not limited to the locking projections 4111 serving as the second locking means that lock the lead connection assisting member as guided by the guide means and as attached to the rear end of the housing. For example, locking projections may be provided on the guide projections 14*a* on the guide plates 14. Alternatively, locking projections may be provided on both the guide projections 14*a* and the guide recesses 411 of the lead connection assisting member 40. It is also possible to provide the second locking means in some other area than the guide projections 14*a* or the guide recesses 411 of the lead connection assisting member. The lead connection assisting member 40 may be provided integrally on the rear end of the housing 10. The second locking means may be provided as any other well-known locking means, such as a combination of a locking projection and a locking recess.

It is possible to omit the block 400.

The electrical connector of the present invention is not limited to the foregoing embodiments with respect to the kinds, shapes, materials of its components, the number of pins, etc. The electrical connector is not limited to a DisplayPort or like plug connector and is applicable to plug connectors of types without a cable connected thereto or to receptacle connectors. The cable c is not limited to a bulk cable, and any other similar cable may be used.

REFERENCE SIGNS LIST

10 housing
20*a* first contact group
21*a* signaling contact
22*a* ground contact
20*b* second contact group
21*b* signaling contact
22*b* ground contact
30 conductive member
31*a*, 31*b* cut-and-raised piece (grounding portion)
32 locking projection (first locking means)
40 lead connection assisting member
4111 locking projection (second locking means)
50 shield cover
60 case
70 lock terminal
100 housing
200*a* first contact group
210*a* signaling contact
220*a* ground contact
200*b* second contact group
210*b* signaling contact
220*b* ground contact
300 multilayer board
310 solid conductor layer
321 upper signaling conductor
322 upper ground conductor
331 lower signaling conductor
332 lower ground conductor
340 through hole (via hole)
400 block
500 shield cover
600 case
700 bush
c cable
c1 lead
c11 core
R receptacle connector
R' receptacle connector

The invention claimed is:

1. An electrical connector comprising:
a housing having a receiving hole;
a first contact group and a second contact group, arranged on opposite sides of the receiving hole in the housing, at least one of the first and second contact groups including a ground contact; and
a conductive member comprising a metal plate, the conducting member being configured to be received in the receiving hole in the housing to be interposed between the first contact group and the second contact group and in contact only with the ground contact out of contacts of the first and second contact groups.

2. The electrical connector according to claim 1, herein the conductive member includes a grounding portion in the form of a projection that is in contact with the ground contact.

3. The electrical connector according to claim 2, wherein the conductive member comprises a metal plate, and the grounding portion comprises a cut-and-raised piece formed by cutting and bending a portion of the conductive member.

4. The electrical connector according to claim 2, wherein first locking means for locking the conductive member received in the receiving hole of the housing is provided on at least one of an inner surface of the receiving hole in the housing and the conductive member.

5. The electrical connector according to claim 1, further comprising:
a shield cover for covering peripheral surfaces of the housing; and
a case for protecting an entire proximal end of the electrical connector.

6. An electrical connector comprising:
a housing having a receiving hole;
a first contact group and a second contact group, arranged on opposite sides of the receiving hole in the housing; and
a conductive member to be received in the receiving hole in the housing to be interposed between the first contact group and the second contact group,
wherein at least one of the first and second contact groups includes a ground contact;
the conductive member received in the receiving hole of the housing is in contact with the ground contact;
the conductive member includes a grounding portion in the form of a projection that is in contact with the ground contact;
the conductive member comprises a plate-like non-conductive material with peripheral surfaces thereof coated with metal; and
the grounding portion comprises the projection provided on the non-conductive material and coated with the metal.

7. An electrical connector comprising:
a housing having a receiving hole;
a first contact group and a second contact group, arranged on opposite sides of the receiving hole in the housing; and
a conductive member to be received in the receiving hole in the housing to be interposed between the first contact group and the second contact group,
wherein at least one of the first and second contact groups includes a ground contact;

the conductive member received in the receiving hole of the housing is in contact with the ground contact; and the conductive member includes:

a first crosstalk reducer on a leading end side thereof, being interposed between middle portions of signaling contacts of the first contact group and middle portions of signaling contacts of the second contact group; and a second crosstalk reducer on a rear end side thereof, being interposed between rear end portions of the signaling contacts of the first contact group and rear end portions of the signaling contacts of the second contact group.

8. The electrical connector according to claim 7, being connectable with a plurality of lead wires and further comprising a lead connection assisting member provided at a rear end of the housing, wherein the signaling contacts of the first and second contact groups have the middle portions arranged on the opposite sides of the receiving hole of the housing and have the rear end portions projecting out of a rear surface of the housing, the lead connection assisting member includes:

first and second support tables for providing support in soldering the rear end portions of the signaling contacts of the first and second contact groups to cores taken from leading ends of the lead wires; and first lead insertion grooves and second lead insertion grooves provided on rear end sides of the first support table and second support table, respectively, the first and second lead insertion grooves being arranged at equal pitch distance to the pitch distance of the signaling contacts of the first and second contact groups, the first and second lead insertion grooves being adapted to receive and temporarily hold the respective leading ends of the lead wires, the first crosstalk reducer is received in the receiving hole in the housing, and the second crosstalk reducer is interposed between a portion of the lead connection assisting member including the first support table and the first lead insertion grooves and a portion of the lead connection assisting member including the second support table and the second lead insertion grooves of the lead connection assisting member.

9. The electrical connector according to claim 7, wherein a pair of guide means for movably guiding the lead connection assisting member in a longitudinal direction are provided on opposite ends of the rear end of the housing.

10. The electrical connector according to claim 9, wherein second locking means is provided on at least one of the paired of guide means and the lead connection assisting member, the second locking means being adapted to lock the lead connection assisting member as guided by the guide means and as attached to the rear end of the housing.

11. The electrical connector according to claim 7, wherein first guide grooves and second guide grooves are provided in the first and second support tables, respectively, of the lead connection assisting member in such a manner as to communicate with the first and second lead insertion grooves, the first and second guide grooves being adapted to guide the rear end portions of the signaling contacts of the first and second contact groups, respectively.

12. The electrical connector according to claim 7, wherein the first and second lead insertion grooves each have a slightly smaller lateral dimension than each lateral dimension of the leading ends of the lead wires such that the leading ends of the lead wires are allowed to be press-fitted and retained in the first and second lead insertion grooves.

13. The electrical connector according to claim 7, wherein the first and second lead insertion grooves each have barbs pointing inward at opposite ends of an open side thereof, the barbs preventing the leading ends of the lead wires from slipping off.

14. An electrical connector comprising:

a housing having a receiving hole;

a first contact group and a second contact group, arranged on opposite sides of the receiving hole in the housing; and a multilayer circuit board to be received in the receiving hole of the housing and be interposed between the first and second contact groups, wherein at least one of the first and second contact groups includes a ground contact;

the multilayer circuit board includes:

a solid conductor layer provided inside the multilayer board;

a ground conductor provided on at least one of opposite surfaces of the multilayer circuit board; and a via hole connecting between the solid conductor layer and the ground conductor; and when the multilayer circuit board is received in the receiving hole, the ground conductor of the multilayer circuit board is in contact with the ground contact.

15. The electrical connector according to claim 14, wherein a rear end of the ground contact is in contact with and soldered to the ground conductor of the multilayer circuit board.

16. The electrical connector according to claim 15, wherein the multilayer circuit board further includes signaling conductors provided on at least one of the opposite surfaces of the multilayer circuit board, and rear end portions of the signaling contacts of the first and second contact groups are in contact with and soldered to the signaling conductors of the multilayer circuit board.

17. The electrical connector according to claim 15, wherein the solid conductor layer includes:

a first crosstalk reducer on a leading end side thereof, interposed between middle portions of the signaling contacts of the first contact group and middle portions of the signaling contacts of the second contact group; and a second crosstalk reducer on a rear end side thereof, interposed between the rear end portions of the signaling contacts of the first contact group and the rear end portions of the signaling contacts of the second contact group.

18. The electrical connector according to claim 16, being connectable with a plurality of lead wires, wherein cores taken from the leading ends of the lead wires can be soldered to at least the respective signaling conductors.

19. The electrical connector according to claim 18, further comprising a block of insulating resin, the block being embedded with the rear end portions of the signaling contacts, the rear end of the ground contact, the leading ends of the lead wires with the cores thereof soldered to the signaling conductors, and the multilayer circuit board excluding a leading end thereof.

20. The electrical connector according to claim 15, being connectable with a plurality of lead wires, wherein cores taken from the leading ends of the lead wires can be soldered at least to the respective rear end portions of the signaling contacts.

21. The electrical connector according to claim 20, further comprising a block of insulating resin, the block being embedded with the rear end portions of the signaling contacts, the rear end of the ground contact, the leading ends of the lead wires with the cores thereof soldered to the rear end portions of the signaling contacts, and the multilayer circuit board excluding a leading end thereof.

22. The electrical connector according to claim 16, wherein the solid conductor layer includes:

a first crosstalk reducer on a leading end side thereof, interposed between middle portions of the signaling contacts of the first contact group and middle portions of the signaling contacts of the second contact group; and a second crosstalk reducer on a rear end side thereof, interposed between the rear end portions of the signaling contacts of the first contact group and the rear end portions of the signaling contacts of the second contact group.

23. An electrical connector comprising:

a housing having a receiving hole;

a first contact group and a second contact group, arranged on opposite sides of the receiving hole in the housing, at least one of the first and second contact groups including a ground contact; and a conductive member configured to be received in the receiving hole in the housing to be interposed between the first contact group and the second contact group and in contact with the ground contact, the conductive member including:

a non-conductive portion of plate-like shape having a peripheral surface, and a metal portion configured to coat the peripheral surface of the non-conductive member.

* * * * *